US010723500B2

(12) United States Patent
Taruno et al.

(10) Patent No.: US 10,723,500 B2
(45) Date of Patent: Jul. 28, 2020

(54) DELAMINATION CONTAINER, METHOD FOR ATTACHING CAP TO DELAMINATION CONTAINER, AND METHOD FOR MANUFACTURING DELAMINATION CONTAINER

(71) Applicant: KYORAKU CO., LTD., Kyoto (JP)

(72) Inventors: Shinsuke Taruno, Kanagawa (JP); Tetsuaki Eguchi, Kanagawa (JP); Kentaro Uchihashi, Kanagawa (JP); Kouichiro Yoshida, Kanagawa (JP)

(73) Assignee: KYORAKU CO., LTD., Kyoto (JP)

( * ) Notice: Subject to any disclaimer, the term of this patent is extended or adjusted under 35 U.S.C. 154(b) by 364 days.

(21) Appl. No.: 15/537,116

(22) PCT Filed: Dec. 9, 2015

(86) PCT No.: PCT/JP2015/084554

§ 371 (c)(1),
(2) Date: Jun. 16, 2017

(87) PCT Pub. No.: WO2016/098668

PCT Pub. Date: Jun. 23, 2016

(65) Prior Publication Data

US 2018/0265241 A1 Sep. 20, 2018

(30) Foreign Application Priority Data

Dec. 9, 2014 (JP) ..... 2014-258105
Dec. 19, 2014 (JP) ..... 2014-258095
(Continued)

(51) Int. Cl.
*B65D 51/16* (2006.01)
*B65D 1/02* (2006.01)
(Continued)

(52) U.S. Cl.
CPC ..... *B65D 1/0215* (2013.01); *B65D 1/023* (2013.01); *B65D 23/02* (2013.01); *B65D 41/16* (2013.01);
(Continued)

(58) Field of Classification Search
CPC ..... B65D 1/0215; B65D 1/022; B65D 1/023; B65D 23/02; B65D 41/16; B65D 77/225; B65D 83/0055; B65D 83/62; B67B 3/22
(Continued)

(56) References Cited

U.S. PATENT DOCUMENTS 5,799,809 A 9/1998 Sako et al.
6,109,468 A 8/2000 Kneer
(Continued)

FOREIGN PATENT DOCUMENTS

JP H04-115114 U 10/1992
JP 3401519 B2 8/1996
(Continued)

OTHER PUBLICATIONS

Japanese Office Action dated Dec. 25, 2018, in connection with counterpart JP Application No. 2015-031081 (6 pgs., including English translation).
(Continued)

*Primary Examiner* — Elizabeth J Volz
(74) *Attorney, Agent, or Firm* — Maier & Maier, PLLC

(57) ABSTRACT

Provided is a delamination container that can suppress deformation of container, when a cap is attached thereto, without being provided with a support ring. The delamination container has a container body with an accommodation section for accommodating contents therein and an opening for discharging the contents from the accommodation section. The accommodation section and the opening have an inner layer, which contracts as the contents decrease, and an
(Continued)

outer layer. The opening has an engagement section with a cap, which is to be attached to the opening, and a constriction section that constricts toward the inner side of the opening. The opening has an upright wall extending from an outer edge of an upper wall of the constriction section at an angle between 34 degrees and 135 degrees relative to the upper wall. There is an inner layer gap between the upright wall and the upper wall.

14 Claims, 20 Drawing Sheets

(30) Foreign Application Priority Data

| | | |
|---|---|---|
| Dec. 19, 2014 | (JP) | 2014-258100 |
| Dec. 19, 2014 | (JP) | 2014-258101 |
| Feb. 19, 2015 | (JP) | 2015-031081 |
| Dec. 3, 2015 | (JP) | 2015-236867 |

(51) Int. Cl.

| | |
|---|---|
| ***B67B 3/22*** | (2006.01) |
| ***B65D 83/00*** | (2006.01) |
| ***B65D 23/02*** | (2006.01) |
| ***B65D 41/16*** | (2006.01) |
| ***B65D 77/22*** | (2006.01) |

(52) U.S. Cl.
CPC ..... *B65D 77/225* (2013.01); *B65D 83/0055* (2013.01); *B67B 3/22* (2013.01)

(58) Field of Classification Search
USPC ..... 215/900; 220/495.03, 495.06, 495.04, 220/62.21, 495.01; 222/95
See application file for complete search history.

(56) References Cited

U.S. PATENT DOCUMENTS

| | | | |
|---|---|---|---|
| 2001/0027154 | A1 | 10/2001 | Nomoto et al. |
| 2013/0161341 | A1 | 6/2013 | Kneer |
| 2014/0374439 | A1 | 12/2014 | Kneer |
| 2015/0210420 | A1 | 7/2015 | Hosokoshiyama |
| 2016/0362216 | A1 | 12/2016 | Hosokoshiyama |
| 2017/0029157 | A1 | 2/2017 | Taruno et al. |

FOREIGN PATENT DOCUMENTS

| | | | | | |
|---|---|---|---|---|---|
| JP | H09-2529 | A | | 1/1997 | |
| JP | 3650175 | B2 | | 3/1997 | |
| JP | H11-292112 | A | | 10/1999 | |
| JP | 2000-513683 | A | | 10/2000 | |
| JP | 2005-212392 | A | | 8/2005 | |
| JP | 2007-320644 | A | | 12/2007 | |
| JP | 2007-320645 | A | | 12/2007 | |
| JP | 2009-179403 | A | | 8/2009 | |
| JP | 2009179403 | | * | 8/2009 | ..... B65D 77/04 |
| JP | 2010-274963 | A | | 12/2010 | |
| JP | 2011-111167 | A | | 6/2011 | |
| JP | 2012-076758 | A | | 4/2012 | |
| JP | 2012076758 | | * | 4/2012 | ..... B65D 51/16 |
| JP | 2012-096815 | A | | 5/2012 | |
| JP | 2012-206736 | A | | 10/2012 | |
| JP | 2013-071776 | A | | 4/2013 | |
| JP | 2013-071782 | A | | 4/2013 | |
| JP | 2013-529580 | A | | 7/2013 | |
| JP | 2014-088004 | A | | 5/2014 | |
| JP | 2014-213906 | A | | 11/2014 | |
| WO | 2014/053212 | A1 | | 4/2014 | |
| WO | 2015/080015 | A1 | | 6/2015 | |

OTHER PUBLICATIONS

Chinese Office Action dated May 31, 2018 in corresponding Chinese Application No. 201580069233.X; 19 pgs.
Office Action dated Mar. 26, 2019 in corresponding Japanese Application No. 2015-031081; 6 pages.
International Search Report dated Feb. 2, 2016 from corresponding International Patent Application No. PCT/JP2015/084554; 2 pgs.
Third-Party Preissuance Submission submitted on Feb. 20, 2019 in corresponding Japanese Application No. 2015-031081; 14 pages including English-language translation.
Partial Supplementary European Search Report dated Nov. 16, 2017, including the Supplementary European Search Report, in connection with counterpart EP Application No. 15869873 (11 pgs.).

* cited by examiner

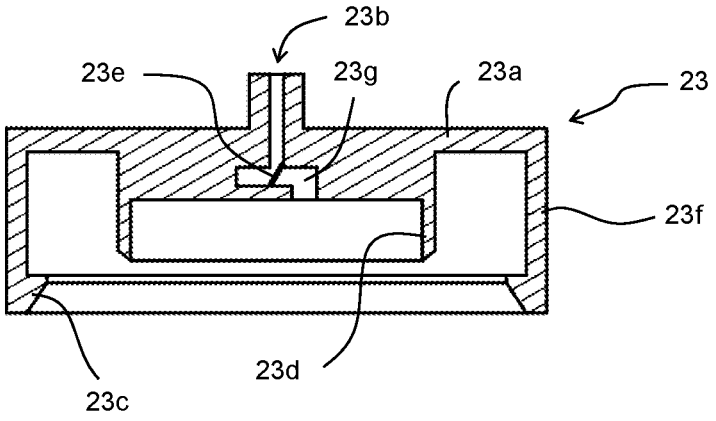
Fig. 3A
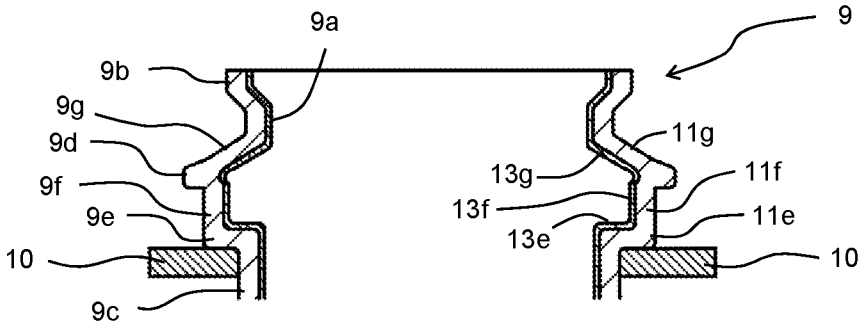
Fig. 3B
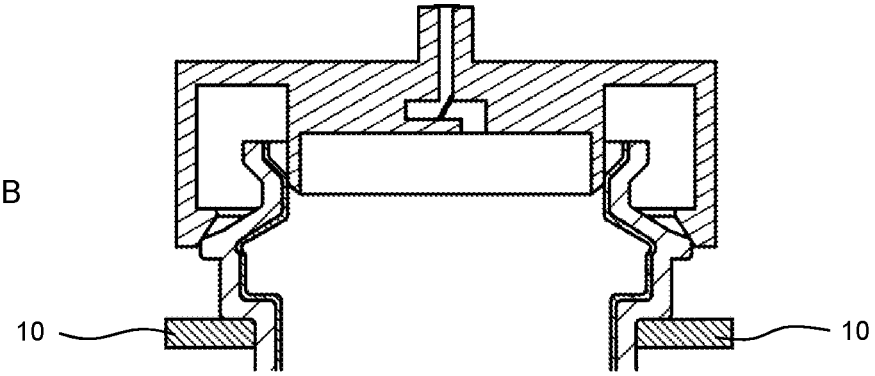
Fig. 3C
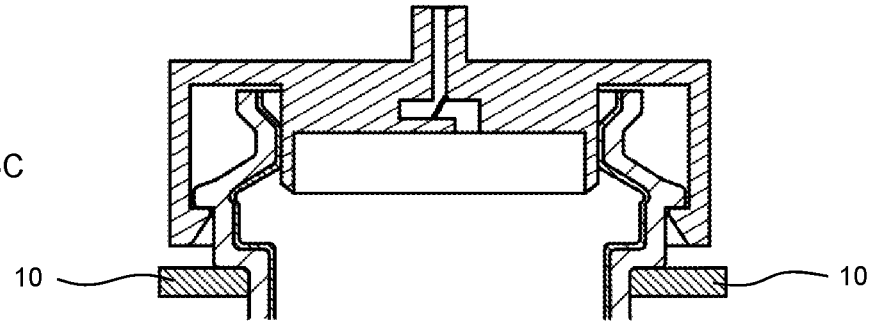

FIRST MODIFICATION OF THE FIRST EMBODIMENT

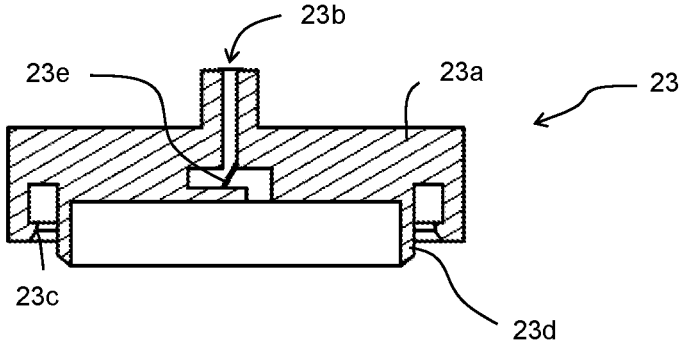
Fig. 5A
SECOND MODIFICATION OF THE FIRST EMBODIMENT
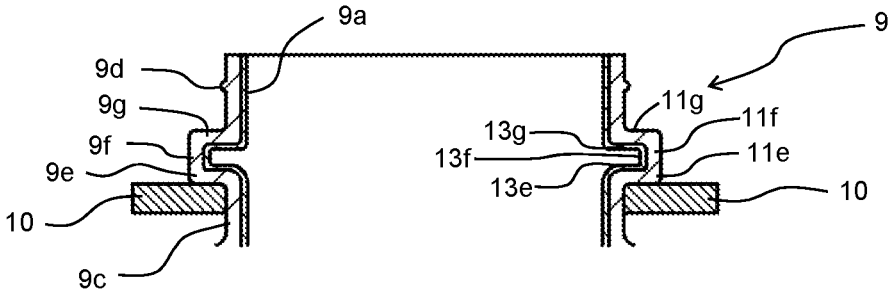
Fig. 5B
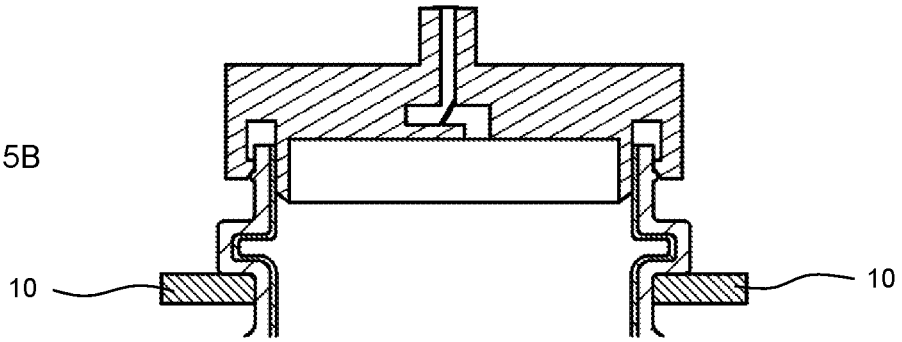
Fig. 5C
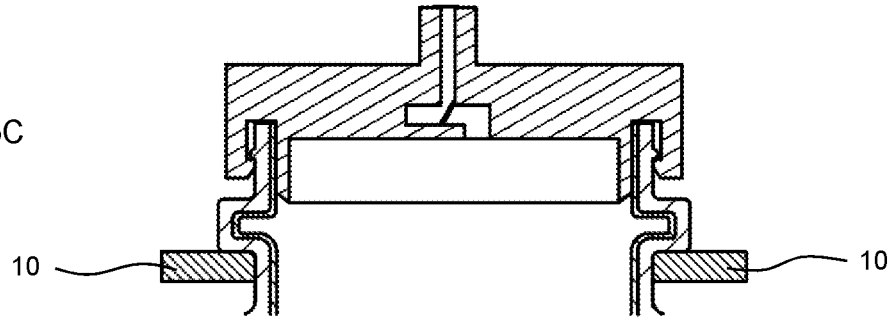

Fig. 6A
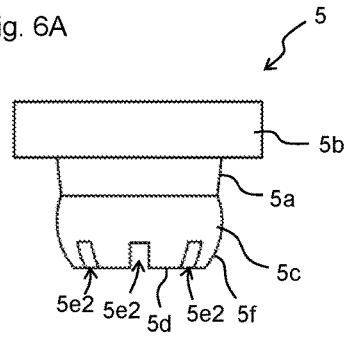
Fig. 6C
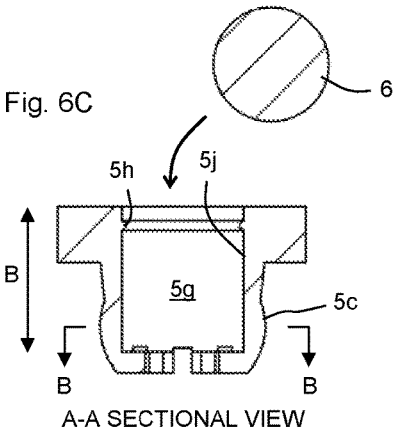
Fig. 6E
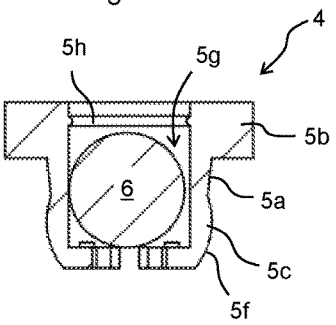
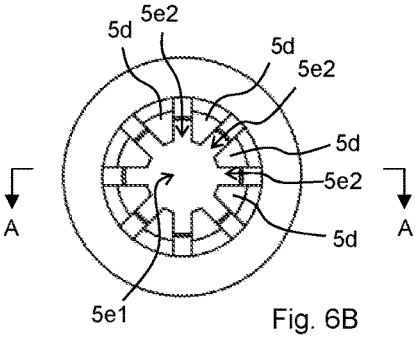
Fig. 6B
Fig. 6D
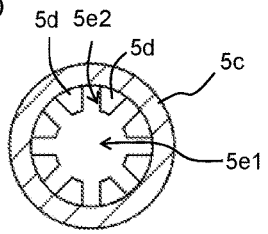
B-B SECTIONAL VIEW
Fig. 6F
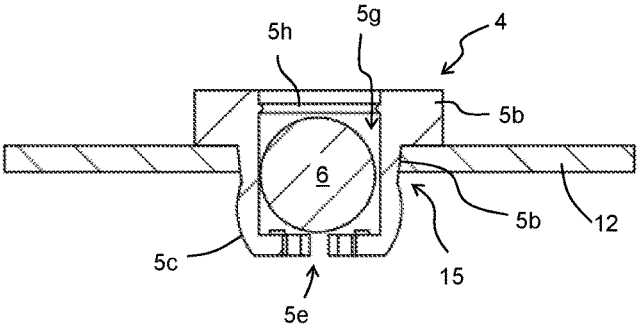
Fig. 6G
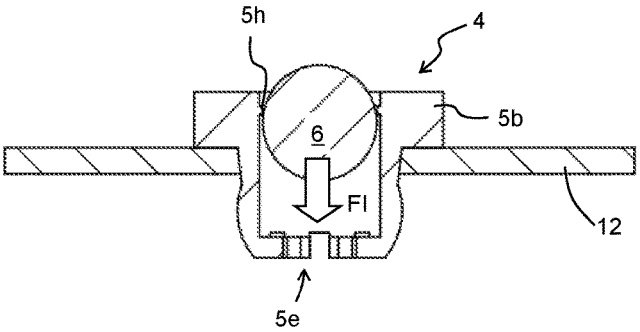

SECOND EMBODIMENT

B-B SECTIONAL VIEW

C-C SECTIONAL VIEW

SECOND EMBODIMENT

B-B SECTIONAL VIEW

C-C SECTIONAL VIEW

FIRST MODIFICATION OF THE SECOND EMBODIMENT

B-B SECTIONAL VIEW

C-C SECTIONAL VIEW

SECOND MODIFICATION OF THE SECOND EMBODIMENT

B-B SECTIONAL VIEW

C-C SECTIONAL VIEW

THIRD MODIFICATION OF THE SECOND EMBODIMENT

B-B SECTIONAL VIEW

C-C SECTIONAL VIEW

THIRD EMBODIMENT

REFERENCE EXAMPLE

FOURTH EMBODIMENT

DELAMINATION CONTAINER, METHOD FOR ATTACHING CAP TO DELAMINATION CONTAINER, AND METHOD FOR MANUFACTURING DELAMINATION CONTAINER

TECHNICAL FIELD

The present invention relates to a delaminatable container having an inner layer delaminating from an outer layer to be shrunk with a decrease in the contents, a method of mounting a cap to the delaminatable container, and a method of manufacturing a delaminatable container.

BACKGROUND ART

PTL 1 discloses configuration of a cap mounted to a beverage bottle. To suppress deformation of bottle in factories, such a cap is generally mounted to a mouth of a bottle while a support ring provided in the mouth of the bottle is supported by a support piece.

In addition, delaminatable containers are known that inhibit entrance of air inside the container by an inner layer delaminated from an outer layer to be shrunk with a decrease in the contents (e.g., PTLs 2 to 3). Such a delaminatable container is provided with an inner bag composed of an inner layer and an outer shell composed of an outer layer. The delaminatable container is generally used by mounting a cap with a check valve to a mouth of a container body.

Such a container body is generally manufactured by blow molding using a tubular laminated parison. The container body has the bottom provided with a sealing portion formed by welding an end of the laminated parison. Since this sealing portion is not resistant to impact, it is provided to protrude from the bottom surface of the container in order to increase the strength. In PTL 3, to increase the strength of the sealing portion even more, welded layers in a sealing portion are welded to be engaged with each other by a plurality of penetration portions.

CITATION LIST

Patent Literature

PTL 1: JP 11-292112A
PTL 2: Japanese Patent No. 3650175
PTL 3: Japanese Patent No. 3401519

SUMMARY OF INVENTION

Technical Problem

First Aspect

In order to suppress deformation of delaminatable container as well when a cap is mounted to the container, the present inventors investigated the possibility of providing a support ring of the same configuration as that in PTL 1 in a mouth of the container. The delaminatable container however has two-layer configuration of an inner layer and an outer layer even in the mouth. They thus found that the support ring is provided in the mouth, causing the inner layer to be caught by the outer layer in the area of the support ring and sometimes causing difficulty in delamination of the inner layer from the outer layer.

The first aspect of the present invention has made in view of such circumstances to provide a delaminatable container that is capable of suppressing deformation of the container when a cap is mounted without providing a support ring.

Second Aspect

The contents in the container are discharged from a cap provided in the mouth of the container by compressing the outer shell. The cap is provided with a check valve. Even when the volume of the contents in the inner bag decreases with the discharge of the contents, fresh air is not introduced into the inner bag and the inner bag is thus shrunk. Meanwhile, to restore the original shape of the outer shell when a compressive force is not applied to the outer shell, a fresh air inlet is provided to introduce fresh air into a space between the outer shell and the inner bag. When the container is small in size or in a similar case, however, the inner bag is not sometimes shrunk smoothly.

The second aspect of the present invention has made in view of such circumstances to provide a delaminatable container having an inner bag to be shrunk smoothly.

Third Aspect

To achieve the configuration in PTL 3, a die is required to have a pin to press a parison welded layer. This causes a more complex die structure, leading to an increase in production cost. It is thus desired to reinforce the sealing portion by simpler configuration.

The third aspect of the present invention has made in view of such circumstances to provide a method of manufacturing a delaminatable container excellent in productivity.

Fourth Aspect

The contents in the container are discharged from a cap provided in the mouth of the container by compressing the outer shell. The cap is provided with a check valve. Even when the volume of the contents in the inner bag decreases with the discharge of the contents, fresh air is not introduced into the inner bag and the inner bag is thus shrunk. Meanwhile, to restore the original shape of the outer shell when a compressive force is not applied to the outer shell, a fresh air inlet is provided to introduce fresh air into a space between the outer shell and the inner bag. Depending on the container shape and the fresh air inlet position, however, the inner bag may not be readily shrunk or the outer shell may not readily restore its shape.

The fourth aspect of the present invention has made in view of such circumstances to provide a delaminatable container having an inner bag to be shrunk immediately and an outer shell to restore its original shape immediately.

Fifth Aspect

The present inventors performed a test by mounting a press-fit cap to a container body of a delaminatable container and found that fresh air sometimes entered inside the container body through a gap between the container body and the cap. Since entrance of fresh air inside the container body causes acceleration of content degradation, it is desired to inhibit entrance of fresh air inside the container body.

The fifth aspect of the present invention has made in view of such circumstances to provide a delaminatable container that is capable of inhibiting entrance of fresh air inside the container body.

Solution to Problem

A description is given below to solutions to the problems in the first to fifth aspects. The solutions in the first to fifth aspects below may be combined with each other.

The first aspect of the present invention provides a delaminatable container, including a container body having a storage portion to store contents and a mouth to discharge the contents from the storage portion, the storage portion and the mouth having an outer layer and an inner layer, and having an inner bag composed of the inner layer to be shrunk with a decrease in the contents, wherein the mouth includes an engagement section to be engaged with a cap mounted to the mouth and a constriction section provided on a storage portion side from the engagement section and constricting inside the mouth, the mouth includes an upright wall extending from an outer edge of an upper wall of the constriction section at an angle between 45 and 135 degrees relative to the upper wall, and a gap is provided between the inner layer at the upper wall and the inner layer at the upright wall.

The present inventors made an intensive investigation on a method for supporting a mouth of a container body by a support without providing a support ring and found that deformation of the container when a cap is mounted is inhibited by providing a constriction section constricting inside the mouth on a lower side from an engagement section to be engaged with the cap mounted to the mouth instead of providing a flanged support ring to support an upper wall of the constriction section by a support.

They also found that the inner layer is prevented from being caught in the outer layer by providing an upright wall extending from an outer edge of the upper wall of the constriction section at an angle between 45 and 135 degrees relative to the upper wall and providing a gap between the inner layer at the upper wall and the inner layer at the upright wall to have come to complete the first aspect of the present invention.

Various embodiments in the first aspect of the present invention are described below as examples. The embodiments below may be combined with each other.

Preferably, the upper wall extends approximately vertically to a central axis of the mouth.

Preferably, the upright wall has an angle between 60 and 120 degrees relative to the upper wall.

Preferably, the container further includes a facing wall extending inside the mouth from an upper edge of the upright wall, wherein a gap is provided between the inner layer at the upper wall and the inner layer at the facing wall.

Preferably, the facing wall has an angle between −10 and 80 degrees relative to the upper wall.

Preferably, the mouth includes an abutment section to abut on an inner ring of the cap, and the abutment section is provided in an area closer to an outlet of the mouth than the engagement section.

Preferably, the mouth circumferentially has a first region provided with the constriction section and a second region provided without the constriction section or provided with a minor constriction section having a constriction amount less than that of the constriction section in the first region, and the second region of the mouth is provided with a fresh air inlet to introduce fresh air into an intermediate space between the outer layer and the inner layer.

Preferably, the fresh air inlet is provided in a position closer to an outlet of the mouth than the upper wall.

Another aspect of the first aspect of the present invention provides a method of mounting a cap to the container above including mounting the cap to the mouth while the mouth is supported by having a support to support the mouth abut on a lower surface of the upper wall when the cap is mounted to the mouth.

The second aspect of the present invention provides a delaminatable container including a container body having an outer shell and an inner bag, the inner bag to be shrunk with a decrease in contents, wherein the inner bag is composed of an inner layer including an innermost layer to contact with the contents and a cover layer slidable over the innermost layer.

The delaminatable container in the second aspect of the present invention has an inner layer configured to include an innermost layer to contact with the contents and a cover layer slidable over the innermost layer. Conventionally, configuration of a cover layer containing an EVOH resin or the like with high oxygen barrier properties integrated with an innermost layer by adhesion has been generally employed. The high rigidity of the EVOH resin accordingly causes difficulty in deformation of the inner layer having the cover layer integrated with the innermost layer and the inner bag is sometimes not smoothly shrunk. In contrast, in the second aspect of the present invention, the innermost layer is not adhered to the cover layer and the innermost layer is slidable over the cover layer. The innermost layer may be accordingly deformed relatively freely even when the cover layer has higher rigidity, and the inner bag is thus shrunk smoothly.

Various embodiments in the second aspect of the present invention are described below as examples. The embodiments below may be combined with each other.

Preferably, the cover layer contains an EVOH resin.

The third aspect of the present invention provides a method of manufacturing a delaminatable container, the container including a container body having an outer shell and an inner bag, the inner bag to be shrunk with a decrease in contents, the container body having a storage portion to store the contents and a mouth to discharge the contents from the storage portion and also having a central recessed region provided in approximate center of a bottom surface of the storage portion and a peripheral region provided surrounding the central recessed region, the central recessed region recessed toward the mouth more than the peripheral region, the method including: sealing portion forming, in blow molding of a tubular laminated parison including an outer layer constituting the outer shell and an inner layer constituting the inner bag, forming a sealing portion of the laminated parison into a thin film in the central recessed region to protrude beyond a plane defined by the peripheral region; and sealing portion processing, bending or melting the sealing portion to accommodate the sealing portion in the central recessed region.

In the third aspect of the present invention, a sealing portion in a thin film shape is formed by compressing a laminated parison to protrude from a central recessed region provided in a bottom surface of the storage portion of the container body, and the sealing portion is subjected to bending or melting to reinforce the sealing portion and also accommodate the sealing portion in the central recessed region. When the delaminatable container is a small container such as an eye drop container, the central recessed region is also recessed in a smaller amount and it is not easy to accommodate the sealing portion in the central recessed region. In the third aspect of the present invention, the sealing portion is in a thin film shape, which facilitates accommodation of the sealing portion in the central recessed region by bending or melting.

Various embodiments in the third aspect of the present invention are described below as examples. The embodiments below may be combined with each other.

Preferably, the sealing portion is formed to have a maximum thickness of ⅓ or less of a thickness of the laminated parison.

Preferably, the sealing portion is formed to have an entirely uniform thickness.

The fourth aspect of the present invention provides a delaminatable container, including a container body having an outer shell and an inner bag, the inner bag to be shrunk with a decrease in contents, wherein the container body includes a storage portion to store the contents and a mouth to discharge the contents from the storage portion, the outer shell includes a fresh air inlet, in the storage portion, communicating an external space with an intermediate space between the outer shell and the inner bag, the storage portion includes a more rigid portion and a less rigid portion with less rigidity than that of the more rigid portion, and the fresh air inlet is provided on a less rigid portion side.

When the delaminatable container in the fourth aspect of the present invention is compressed, the less rigid portion is preferentially pressed and greatly deformed, causing noticeable inner layer delamination on the less rigid portion side. In addition, a fresh air inlet is provided on the less rigid portion side to immediately introduce fresh air in inner layer delamination on the less rigid portion side, causing inner layer delamination to proceed much more immediately and the outer shell to restore its original shape immediately.

Various embodiments in the fourth aspect of the present invention are described below as examples. The embodiments below may be combined with each other.

Preferably, the storage portion has a tubular portion in a tubular shape and a panel portion formed by depressing a portion of the tubular portion, and the panel portion is the more rigid portion and the tubular portion is the less rigid portion.

Preferably, in the tubular portion, the fresh air inlet is provided in a position facing the panel portion.

The fifth aspect of the present invention provides a delaminatable container, including: a container body and a press-fit cap mounted to the container body, wherein the container body is configured to include a storage portion to store contents and a mouth having an opening to discharge the contents from the storage portion, the storage portion and the mouth having an outer layer and an inner layer, and having an inner bag composed of the inner layer to be shrunk with a decrease in the contents, the mouth includes a mouth-side engagement section provided along an outer circumference of the mouth, the cap includes a cap-side engagement section provided along an inner circumference of the cap, the mouth-side engagement section and the cap-side engagement section are configured to be engageable with each other while the cap is mounted to the mouth, and at least one of the cap and the mouth includes a tilt suppressor to suppress a tilt of the cap relative to the mouth by narrowing a gap between the mouth and the cap in a position more distant from the opening than the cap-side engagement section while the cap is mounted to the mouth.

The present inventors investigated the cause of fresh air entrance and found that a cap sometimes tends to tilt relative to the mouth depending on the shape of the mouth of the container body and the shape of the press-fit cap and the cause is the tendency to form a gap between the cap and the mouth due to the tilt of the cap. Based on the findings, the inventors found that entrance of fresh air inside the container body is inhibited by providing a tilt suppressor to suppress the tilt of the cap relative to the mouth to have come to complete the fifth aspect of the present invention.

Various embodiments in the fifth aspect of the present invention are described below as examples. The embodiments below may be combined with each other.

Preferably, the tilt suppressor is a mouth-side protrusion provided on the outer circumference of the mouth.

Preferably, the container further includes a constriction section constricting inside the mouth provided on a storage portion side from the mouth-side engagement section, wherein the mouth-side protrusion is provided between an upper wall of the constriction section and the mouth-side engagement section.

Preferably, the tilt suppressor is a cap-side protrusion provided on the inner circumference of the cap.

Preferably, the storage portion includes a fresh air inlet communicating an external space with an intermediate space between the outer layer and the inner layer.

BRIEF DESCRIPTION OF DRAWINGS

Drawings of Embodiments in the First to Fourth Aspects of the Invention

FIGS. 3A to 3C are cross-sectional views corresponding to FIG. 2 illustrating a procedure of mounting a cap 23 to a mouth 9 of the container body 3 in FIGS. 1A to 2.

FIGS. 5A to 5C are cross-sectional views corresponding to FIGS. 3A to 3C illustrating a mouth 9 and a cap 23 in a second modification of the first embodiment.

FIG. 6A is a front view of a tube 5, FIG. 6B is a bottom view of the tube 5, FIG. 6C is an A-A cross-sectional view, FIG. 6D is a B-B cross-sectional view, FIG. 6E is a cross-sectional view of the valve member 4, FIG. 6F is a cross-sectional view illustrating a state of mounting the valve member 4 to an outer shell 12, and FIG. 6G is a cross-sectional view illustrating a state where a mobile part 6 abuts on a stopper 5*h* to close a cavity 5*g*.

FIG. 9A is a cross-sectional view corresponding to a section A-A in FIG. 2 and FIGS. 9B to 9C are a B-B cross sectional view and a C-C cross sectional view in FIG. 9A.

FIG. 11A is a cross-sectional view corresponding to the section A-A in FIG. 2 and FIGS. 11B and 11C are a B-B cross sectional view and a C-C cross sectional view in FIG. 11A.

FIG. 12A is a cross-sectional view corresponding to the section A-A in FIG. 2 and FIGS. 12B and 12C are a B-B cross sectional view and a C-C cross sectional view in FIG. 12A.

FIG. 13A is a cross-sectional view corresponding to the section A-A in FIG. 2 and FIGS. 13B and 13C are a B-B cross sectional view and a C-C cross sectional view in FIG. 13A.

Drawings of Embodiments in the Fifth Aspect of the Invention

Figure 14A:
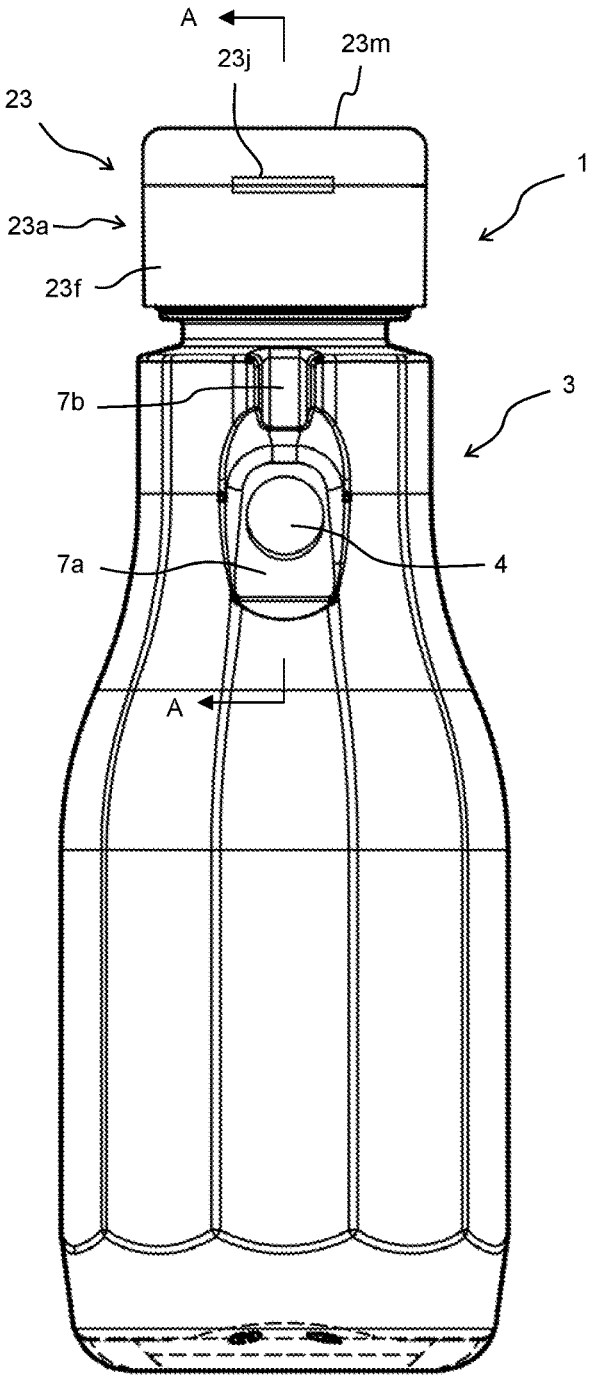
Figure 14B:
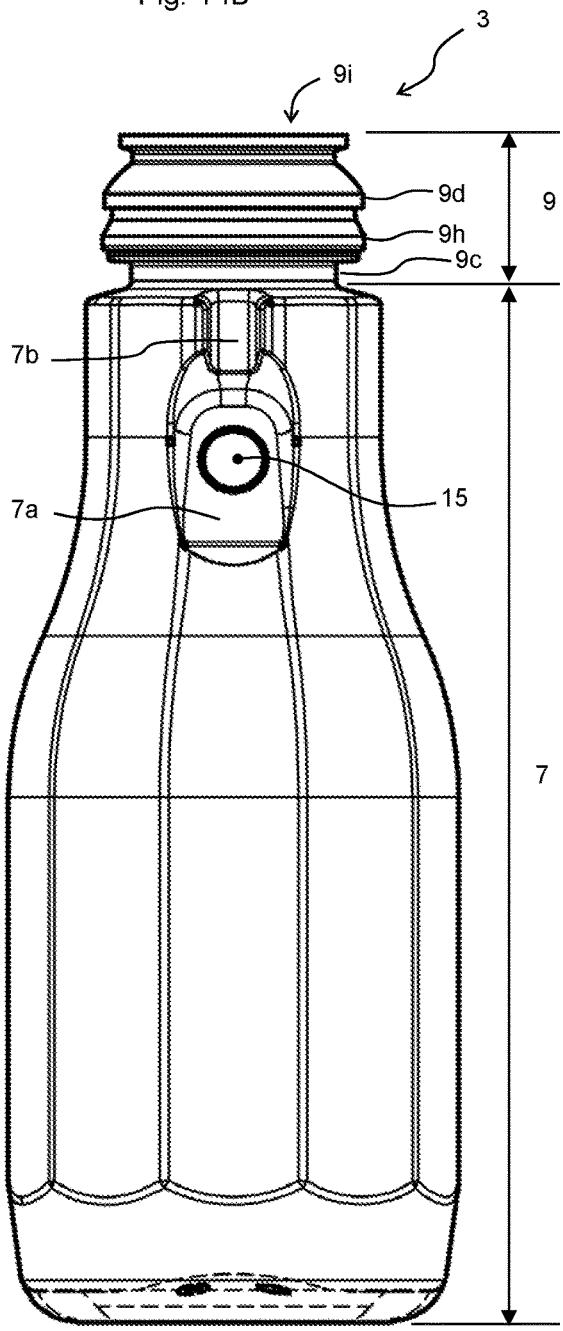

FIGS. 14A and 14B illustrate a delaminatable container 1 in a third embodiment of the present invention, where FIG. 14A is a front view in the state where a cap 23 and a valve member 4 are mounted to a container body 3 and FIG. 14B is a front view only illustrating the container body 3.

Figure 15A:
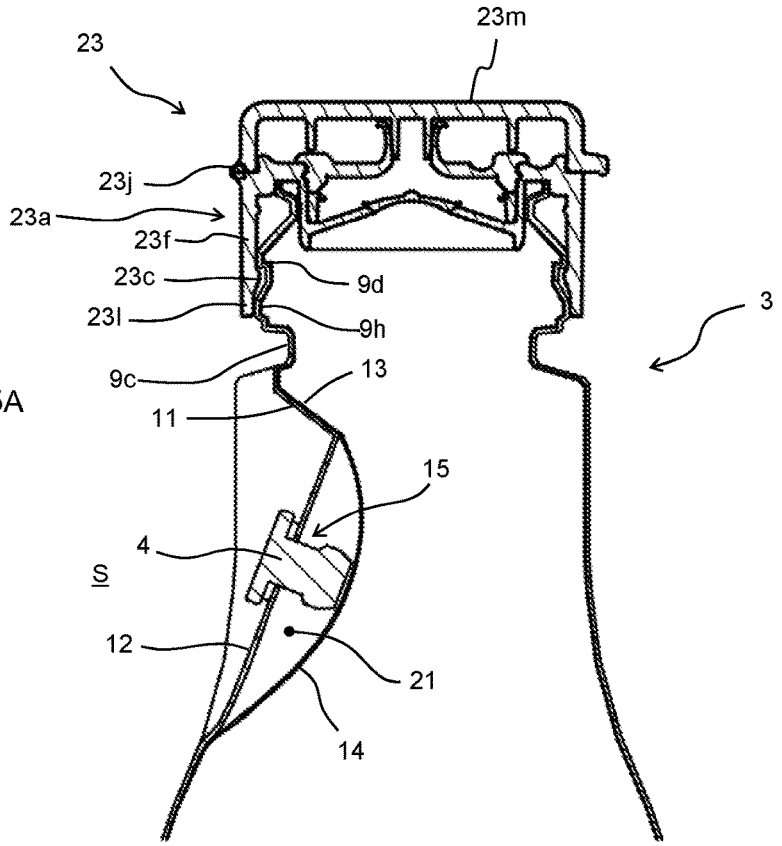
Figure 15B:
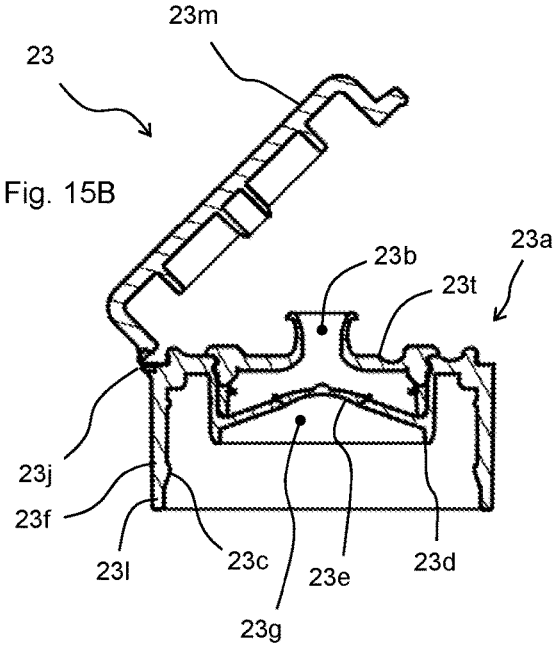
Figure 15C:
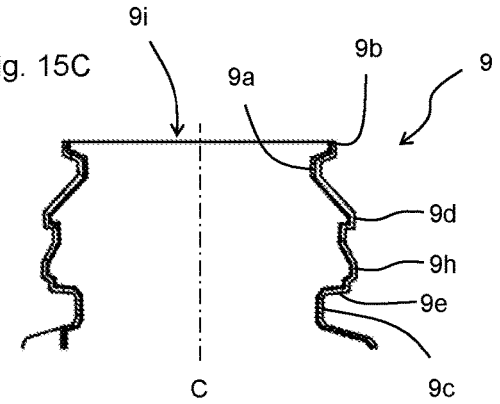

FIG. 15A is an A-A cross-sectional view in FIG. 14A, FIG. 15B is a cross-sectional view in the state where a cap cover 23*m* of the cap 23 in FIG. 15A is opened, and FIG. 15C is a cross-sectional view illustrating a mouth 9 extracted from FIG. 15A.

Figure 16A:
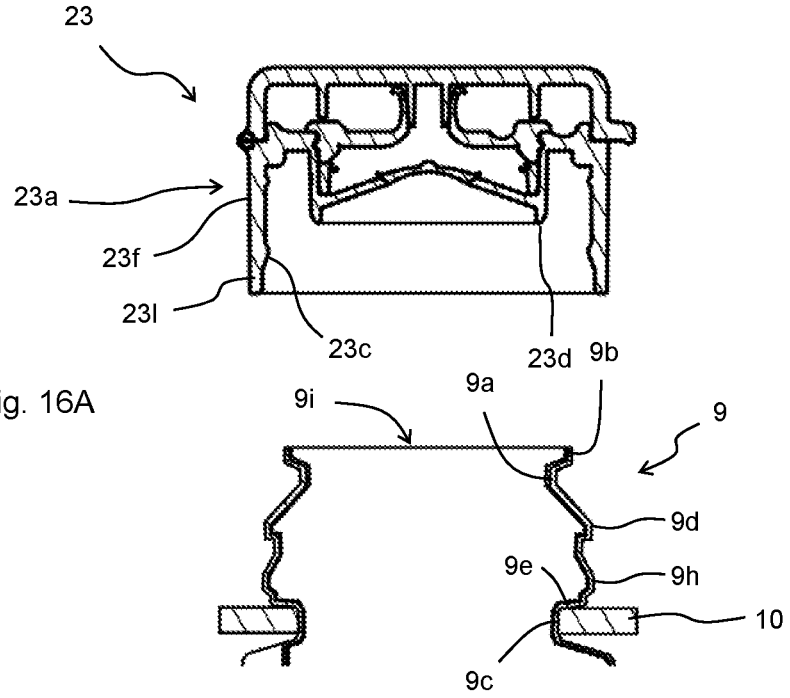
Figure 16B:
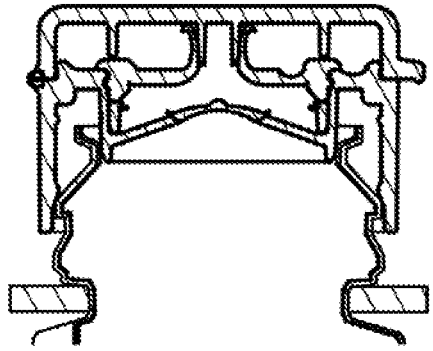

FIGS. 16A and 16B are cross-sectional views corresponding to FIG. 15A to illustrate a procedure of mounting the cap 23 to the mouth 9.

Figure 17A:
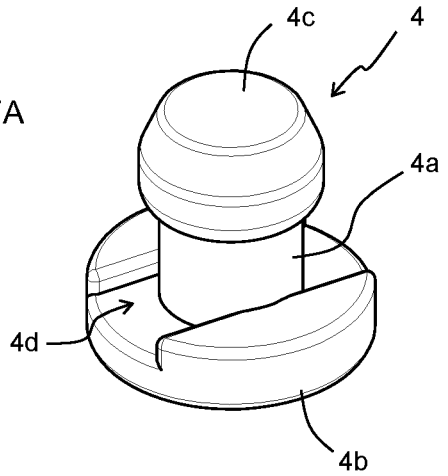
Figure 17B:
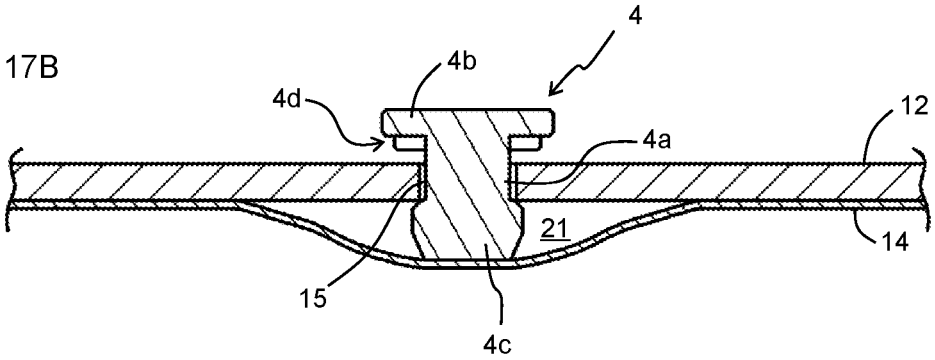
Figure 17C:
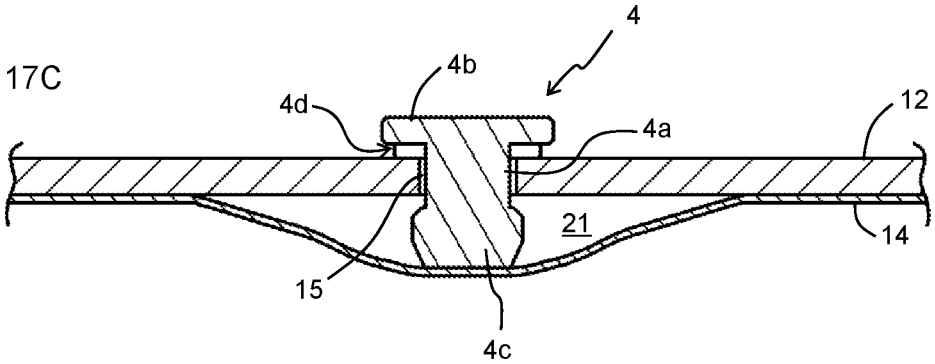

FIG. 17A is a perspective view of a valve member 4 and FIGS. 17B and 17C are cross-sectional views illustrating motion of the valve member 4.

Figure 18:
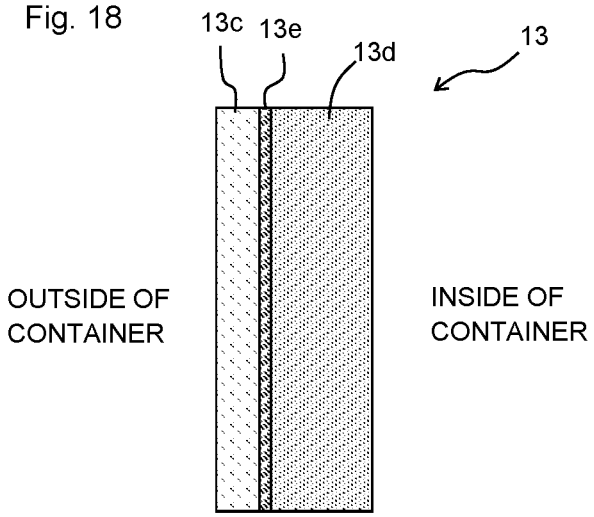

FIG. 18 is a cross-sectional view illustrating layer configuration of an inner layer 13.

Figure 19:
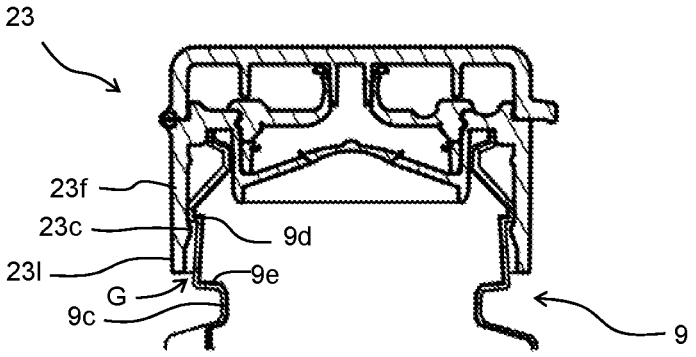

FIG. 19 is a cross-sectional view corresponding to FIG. 15A illustrating a mouth 9 and a cap 23 in a reference example of the present invention.

Figure 20A:
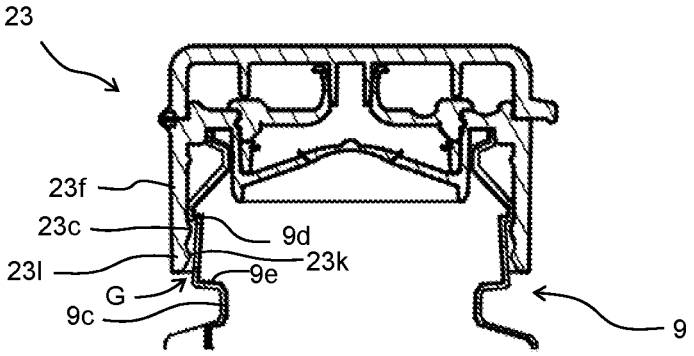
Figure 20B:
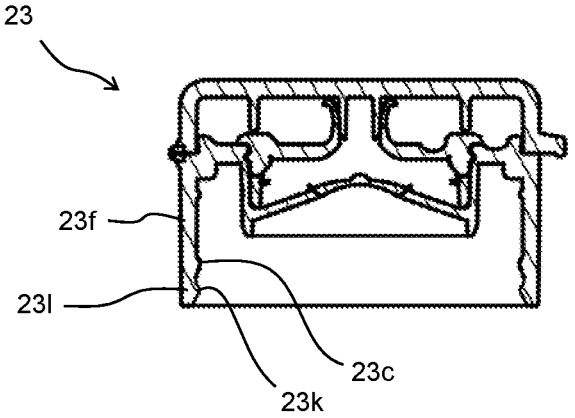

FIGS. 20A and 20B are cross-sectional views corresponding to FIG. 15A illustrating a mouth 9 and a cap 23 in a fourth embodiment of the present invention.

DESCRIPTION OF EMBODIMENTS

Embodiments of the present invention are described below. Various characteristics in the embodiments described below may be combined with each other. Each characteristic is independently inventive. Descriptions are given to embodiments in the first to fourth aspects of the present invention first, and then to embodiments in the fifth aspect of the present invention. The characteristics described in the embodiments of the first to fourth aspects may be combined with the characteristics described in embodiments of the fifth aspect.

Embodiments in the First to Fourth Aspects of the Invention

1. First Embodiment

As illustrated in FIGS. 1A through 2D, a delaminatable container 1 in the first embodiment of the present invention is provided with a container body 3 and a valve member 4. The container body 3 is provided with a storage portion 7 to store the contents and a mouth 9 to deliver the contents from the storage portion 7.

Figure 2:
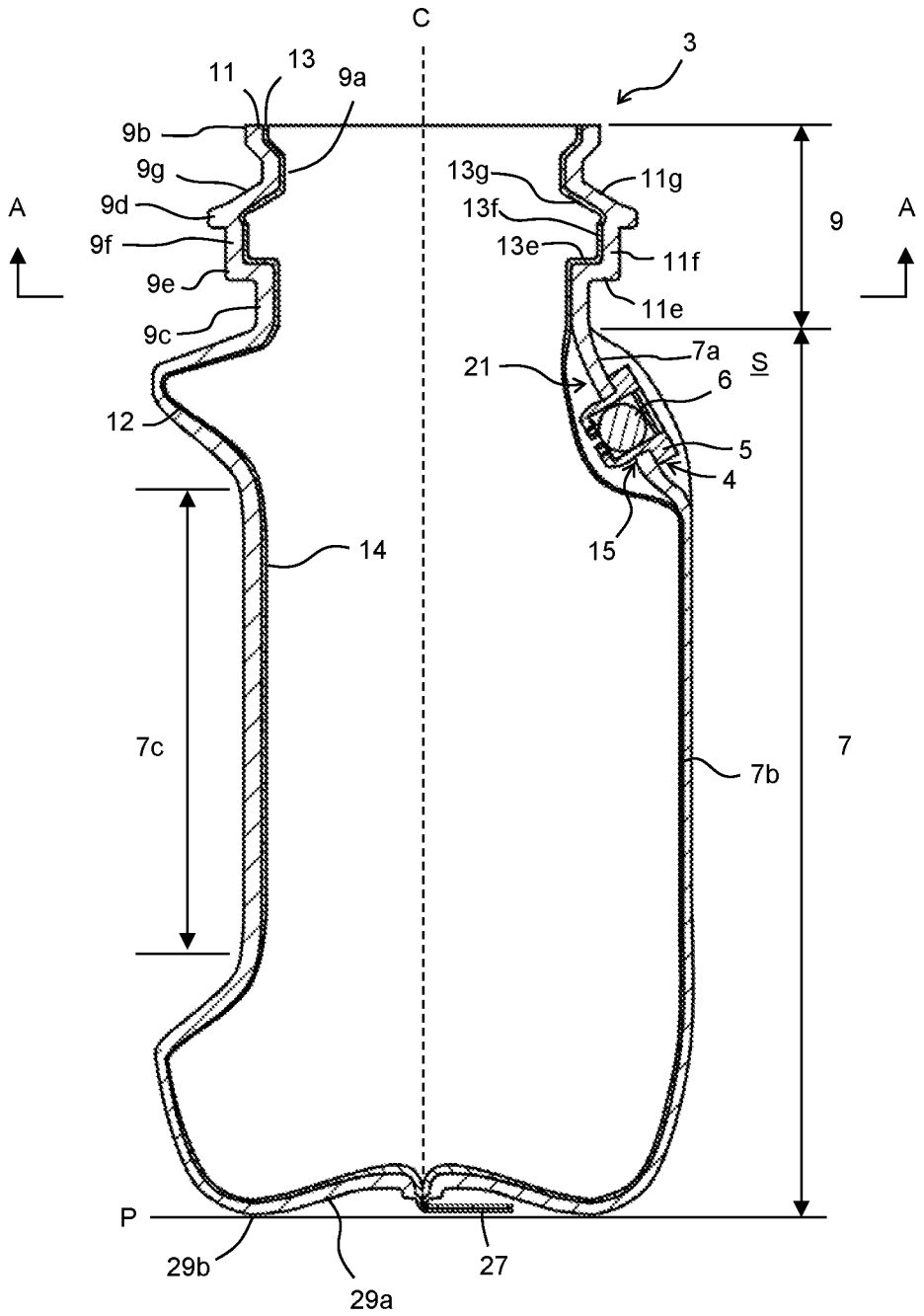
FIG. 2 is a cross-sectional view illustrating a state where a valve member 4 is mounted to the container body 3 in FIGS. 1A and 1B and a sealing portion 27*a* is subjected to bending to form a bottom sealing portion 27.

As illustrated in FIG. 2, the container body 3 includes an outer layer 11 and an inner layer 13 in the storage portion 7 and the mouth 9, where the outer layer 11 constitutes an outer shell 12 and the inner layer 13 constitutes an inner bag 14. Due to separation of the inner layer 13 from the outer layer 11 with a decrease in the contents, the inner bag 14 separates from the outer shell 12 to be shrunk. Preliminary delamination is sometimes performed to delaminate the inner layer 13 from the outer layer 11 prior to storage of the contents in the storage portion 7. In this case, the inner layer 13 is contacted with the outer layer 11 by blowing air or storing the contents in the storage portion 7 after preliminary delamination. The inner layer 13 then separates from the outer layer 11 with a decrease in the contents. Meanwhile, when preliminary delamination is not performed, the inner layer 13 is delaminated from the outer layer 11 in discharge of the contents to separate from the outer layer 11.

The mouth 9 includes an engagement section 9*d*. In the present embodiment, the mouth 9 is assumed to have a press-fit cap 23 mounted thereto as illustrated in FIGS. 3A to 3C. The engagement section 9*d* is a ring-shaped projection to be engaged with an engagement section 23*c* of the cap 23. Note that, in other embodiments, a cap, a pump, or the like with an internal thread may be mounted to the mouth 9, and in such a case, the engagement section 9*d* is configured with an external thread.

The mouth 9 also includes a constriction section 9*c* constricting inside the mouth 9 on the storage portion 7 side from the engagement section 9*d*. The constriction section 9*c* has an upper wall 9*e* extending approximately vertically to a central axis C of the mouth 9. The mouth 9 also includes an upright wall 9*f* extending from an outer edge of the upper wall 9*e* at an angle between 45 and 135 degrees relative to the upper wall 9*e*. The upright wall 9*f* has an angle to the upper wall 9*e* preferably from 60 to 120 degrees and more preferably from 75 to 105 degrees. In the present embodiment, the upright wall 9*f* approximately vertically extends to the upper wall 9*e*. Between an inner layer 13*e* at the upper wall 9*e* and an inner layer 13*f* at the upright wall 9*f*, a gap is provided and the inner layer 13*e* and the inner layer 13*f* are not integrated. In other words, the inner layer 13 is not caught in an outer layer 11*e* at the upper wall 9*e* and an outer layer 11*f* at the upright wall 9*f*.

In addition, a facing wall 9*g* is provided extending from an upper edge of the upright wall 9*f* inside the mouth 9 (in the central axis C direction). The facing wall 9*g* is at an angle to the upper wall 9*e* for example, but not particularly limited to, from −10 to 80 degrees and of approximately 30 degrees in the present embodiment. Between the inner layer 13*e* at the upper wall 9*e* and an inner layer 13*g* at the facing wall 9*g*, a gap is provided and the inner layer 13*e* and the inner layer 13*g* are not integrated. In other words, the inner layer 13 is not caught in the outer layer 11*e* at the upper wall 9*e* and an outer layer 11*g* at the facing wall 9*g*.

As just described, in the present embodiment, the inner layer 13 is not confined to the outer layer 11 in the mouth 9, and the inner layer 13 thus smoothly delaminates from the outer layer 11.

Next, with reference to FIGS. 3A to 3C, a method of mounting the cap 23 to the mouth 9 is described. The cap 23 to be mounted includes a cap body (body portion) 23*a*, an outlet 23*b* provided in the cap body 23*a*, the engagement section 23*c* provided at an approximate end of a tubular portion (outer circumference portion) 23*f* cylindrically extending from the cap body 23*a*, an inner ring 23*d* cylindrically extending from the cap body 23*a* inside the tubular portion 23*f*, a flow passage 23*g* provided inside the inner ring 23*d* and communicating with the outlet 23*b*, and a check valve 23*e* provided in the flow passage 23*g*. While the cap 23 is mounted to the mouth 9, the contents in the storage portion 7 are discharged from the outlet 23*b* through the flow passage 23*g*. Meanwhile, the check valve 23*e* blocks an incoming flow of fresh air from the outlet 23*b*, and fresh air does not enter inside the inner bag 14 of the container body 3 to inhibit content degradation. The structure of the cap 23 described here is merely an example, and for example, a cap 23 having a check valve of another configuration may be employed.

For mounting of the cap 23, first, to suppress deformation of the storage portion 7 due to the impact of mounting the cap 23, as illustrated in FIG. 3A, a support 10 is brought to abut on a lower surface of the upper wall 9*e* of the constriction section 9*c*. In that state, as illustrated in FIGS. 3B to 3C, the engagement section 23*c* of the cap 23 is engaged with the engagement section 9*d* of the mouth 9. When the engagement section 23*c* passes over the engagement section 9*d* from the state in FIG. 3B, the tubular portion 23*f* of the cap 23 transforms to enlarge the diameter and the mouth 9 transforms to reduce the diameter, and thus it is easier to mount the cap 23 when the mouth 9 readily transforms. The mouth 9 in the present embodiment is however not provided with a support ring as disclosed in JP 11-292112A and the mouth 9 is supported by having the support 10 abutting on the lower surface of the upper wall 9*e* of the constriction section 9*c*. The mouth 9 thus readily transforms, and mounting of the cap 23 is facilitated. In addition, since the mouth 9 readily transforms, the inner bag 14 readily transforms in the area near a container opening and it helps to use the contents up.

The mouth 9 also includes an abutment section 9*a* on which an outer surface of the inner ring 23*d* abuts. Leakage of the contents is prevented by the outer surface of the inner ring 23*d* abutting on the abutment section 9*a* of the mouth 9. In the present embodiment, the mouth 9 is equipped with an enlarged diameter portion 9*b* at the end. The enlarged diameter portion 9*b* has an inner diameter greater than the inner diameter in an abutment portion 9*a*, and thus the outer surface of the inner ring 23*d* does not make contact with the enlarged diameter portion 9*b*. When the mouth 9 does not have the enlarged diameter portion 9*b*, a defect sometimes occurs in which the inner ring 23*d* enters between the outer layer 11 and the inner layer 13 in the case where the mouth 9 has an even slightly smaller inner diameter due to variations in manufacturing. In contrast, when the mouth 9 has the enlarged diameter portion 9*b*, such defect does not occur even in the case where the mouth 9 has a slightly varied inner diameter.

Even when the mouth 9 includes the enlarged diameter portion 9*b*, there is a risk of delamination of the inner layer 13 from the outer layer 11 due to the friction between the inner ring 23*d* and the abutment section 9*a*. In the present embodiment, however, the constriction section 9*c* is provided in a position closer to the storage portion 7 than the abutment section 9*a* to inhibit slipping off of the inner layer 13 by the constriction section 9*c*. Dropping of the inner bag 14 into the outer shell 12 is thus inhibited. The constriction section 9*c* thus has a function of inhibiting slipping off of the inner layer 13 and also has a function as a support area for the mouth 9 by the support 10 when the cap 23 is mounted.

Here, with reference to FIGS. 4A to 5C, a mouth 9 and a cap 23 in the first to second modifications of the first embodiment are described.

Figure 4A:
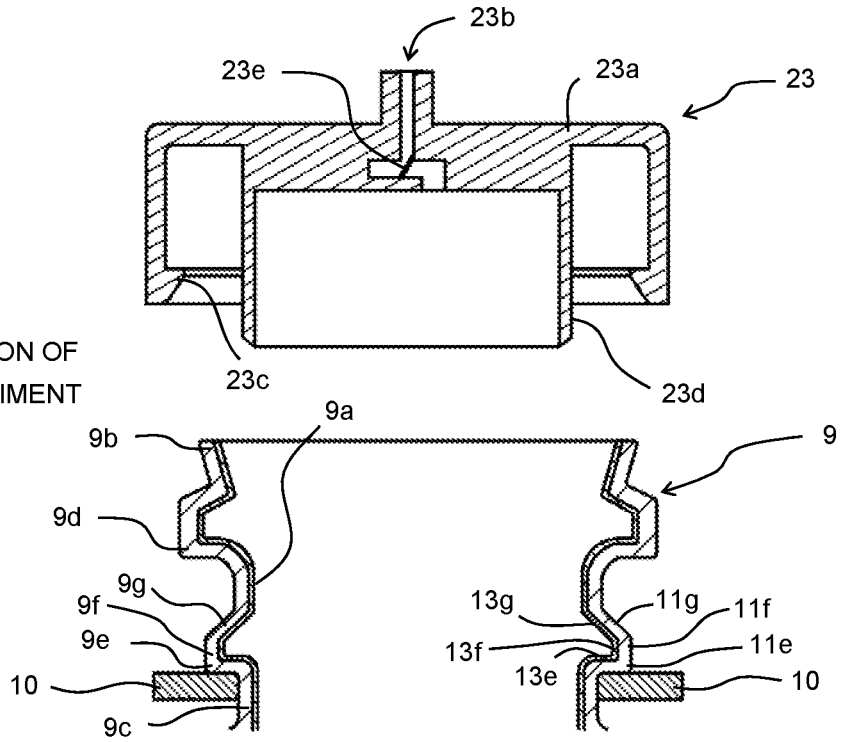
FIGS. 4A to 4C are cross-sectional views corresponding to FIGS. 3A to 3C illustrating a mouth 9 and a cap 23 in a first modification of the first embodiment.
Figure 4B:
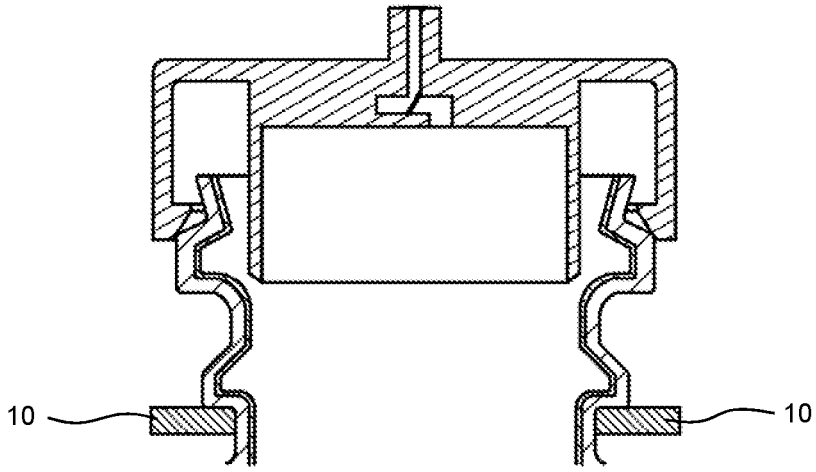
Figure 4C:
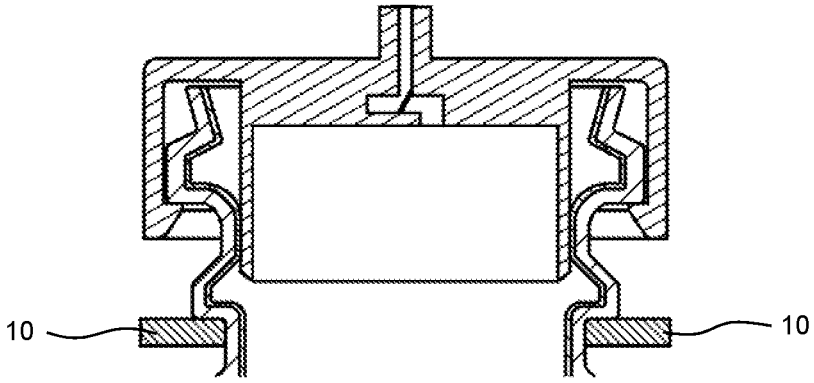

The first modification illustrated in FIGS. 4A to 4C mainly differs in the position of an abutment section 9*a* from the configuration in FIGS. 3A to 3C. In the configuration of FIGS. 3A to 3C, the abutment section 9*a* is in a position closer to the container opening than the engagement section 9*d*, whereas in the configuration of FIGS. 4A to 4C, the abutment section 9*a* is distant from the container opening relative to the engagement section 9*d* and is provided between the engagement section 9*d* and the constriction section 9*c*. Although either configuration may be applied, the configuration in FIGS. 3A to 3C is more advantageous in that, in addition to the volume of the container body 3 can be effectively used, the inner layer 13 is delaminatable in a position closer to the container opening to discharge the contents fully.

The second modification illustrated in FIGS. 5A to 5C mainly differs in a facing wall 9*g* approximately parallel to the an upper wall 9*e* to form a horizontally-flipped approximate U shape by the upper wall 9*e*, an upright wall 9*f*, and the facing wall 9*g* from the configuration in FIGS. 3A to 3C. In such configuration, a gap is provided between the inner layers 13*e*, 13*f*, 13*g* and they are not integrated, and the actions and effects are thus obtained that are same as those in the configuration of FIGS. 3A to 3C. In the configuration of FIGS. 5A to 5C, a shorter distance between the upper wall 9*e* and the facing wall 9*g* tends to cause contact of the inner layer 13*e* with the inner layer 13*g* to be integrated. The distance between the lower surface of the upper wall 9*e* and an upper surface of the facing wall 9*g* is preferably 2.5 times or more of the thickness of the upper wall 9*e* (total thickness of the outer layer 11*e* and the inner layer 13*e*). In this case, a gap with approximately half thickness of the thickness of the upper wall 9*e* is formed between the inner layer 13*e* and the inner layer 13*g*.

Figure 1A:
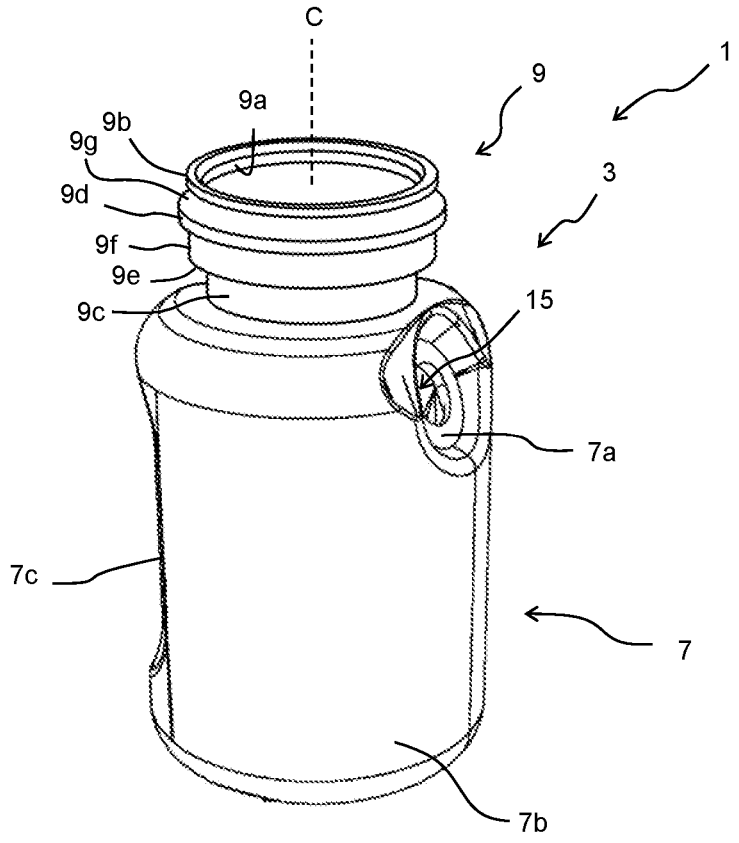
FIGS. 1A and 1B are perspective views illustrating the structure of a container body 3 of a delaminatable container 1 in a first embodiment of the present invention.

As illustrated in FIGS. 1A to 2, the storage portion 7 is in an approximately cylindrical shape and has a tubular portion 7*b* in a tubular shape and a panel portion 7*c* formed by depressing a portion of the tubular portion 7*b*. Since the container body 3 is formed by blow molding of a tubular (e.g., cylindrical) laminated parison, the container body 3 has a smaller thickness in an area at a greater blow ratio (an area more distant from the central axis C). Since the panel portion 7*c* is closer to the central axis C than the tubular portion 7*b*, it has a greater thickness than that of the tubular portion 7*b*. The panel portion 7*c* accordingly has greater rigidity than that of the tubular portion 7*b*, and the panel portion 7*c* becomes a more rigid portion and the tubular portion 7*b* becomes a less rigid portion.

The contents in the storage portion 7 are discharged by deformation due to compression of the storage portion 7. When the tubular portion 7*b* and the panel portion 7*c* are pinched to compress the storage portion 7, the less rigid tubular portion 7*b* is preferentially deformed and the amount of deformation in the tubular portion 7*b* is greater than that in the panel portion 7*c*. Since the inner layer 13 tends to be delaminated from the outer layer 11 in the area of a greater amount of deformation, delamination of the inner layer 13 tends to preferentially proceed in the tubular portion 7*b*. In the present embodiment, the outer shell 12 includes a fresh air inlet 15, in the storage portion 7, communicating an external space S of the container body 3 with an intermediate space 21 between the outer shell 12 and the inner bag 14. Since the fresh air inlet 15 is provided on the tubular portion (less rigid portion) 7*b* side, fresh air is smoothly introduced into the intermediate space 21 between the outer shell 12 and the inner bag 14 when the inner layer 13 is delaminated and the inner layer 13 is smoothly delaminated from the outer layer 11. Accordingly, the inner bag 14 is smoothly shrunk when the storage portion 7 is compressed and the outer shell 12 smoothly restores its original shape when the compressive force is removed.

While the fresh air inlet 15 may be provided in an arbitrary position of the tubular portion (less rigid portion) 7*b*, it is preferably provided in a position facing the panel portion 7*c*. This is because, when tubular portion 7*b* and the panel portion 7*c* are pinched to compress the storage portion 7, the tubular portion 7*b* is most greatly deformed in the position facing the panel portion 7*c*.

In the present embodiment, the fresh air inlet 15 includes the valve member 4 to regulate entrance and exit of air between the intermediate space 21 and the external space S. The valve member 4 is mounted to a valve member mounting recess 7*a* provided in the storage portion 7. When the storage portion 7 is compressed, the valve member 4 of is closed to block an air flow from the intermediate space 21 to the external space S and thus has a function of increasing the pressure in the intermediate space 21 to facilitate transmission of the pressure exerted on the outer shell 12 to the inner bag 14. Accordingly, even when the contents in the inner bag 14 are decreased, the contents are readily discharged. In contrast, when the compressive force applied to the storage portion 7 is removed, the valve member 4 is opened and has a function of passing therethrough the air from the external space S to the intermediate space 21. Accordingly, fresh air is introduced into the intermediate space 21 and the outer shell 12 smoothly restores its original shape. The valve member 4 is not an essential component because, even with no valve member 4, the inner bag 14 can be directly compressed through the outer shell 12 by greatly deforming the outer shell 12.

As just described, the valve member 4 may have a function of opening and closing the fresh air inlet 15, and the configuration examples include a configuration where the valve member 4 itself is provided with a through hole and an on-off valve, which acts to open and close the through hole for opening and closing of the fresh air inlet 15 and a configuration where a gap between the valve member 4 and an edge of the fresh air inlet 15 is opened and closed by movement of the valve member 4 for opening and closing of the fresh air inlet 15 by the valve member 4. The former valve member 4 is suitably applied to a particularly small container, such as an eye drop container, because the valve member 4 functions with no problem even when the size of the fresh air inlet 15 is somewhat varied.

Figure 7A:
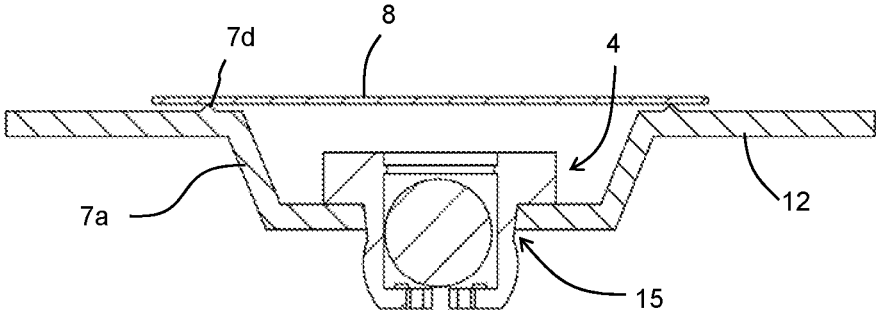
FIGS. 7A and 7B are cross-sectional views illustrating examples of using a sealing member 8 as a cover.
Figure 7B:
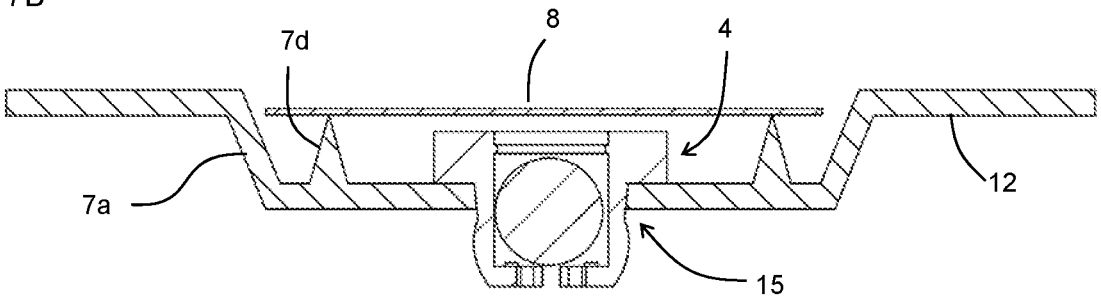

Here, with reference to FIGS. 2 and 7A to 7B, an example of the valve member 4 is described. The valve member 4 is provided with a tube 5 having a cavity 5*g* provided to communicate the external space S with the intermediate space 21 and a mobile part 6 movably stored in the cavity 5*g*. The tube 5 and the mobile part 6 are formed by injection molding or the like, and the mobile part 6 is disposed in the cavity 5*g* by pressing the mobile part 6 into the cavity 5*g* to pass over a stopper 5*h* described later. In the present embodiment, the cavity 5*g* has an approximately cylindrical shape and the mobile part 6 has an approximately spherical shape while they may have another shape as long as the shape is capable of achieving same functions as those in the present embodiment. The cavity 5*g* has a diameter in a horizontal cross section (cross section in FIG. 6D) slightly larger than the corresponding diameter of the mobile part 6 and has a shape allowing the mobile part 6 to freely move in arrow B directions in FIG. 6C. A value of the ratio defined by the diameter of the cavity 5*g* in the horizontal cross section/the corresponding diameter of the mobile part 6 is preferably from 1.01 to 1.2 and more preferably from 1.05 to 1.15. This is because a too small value of the ratio causes interference with smooth movement of the mobile part 6 and a too large value of this ratio causes an excessive increase in the gap between the mobile part 6 and a surface 5*j* surrounding the cavity 5*g* and thus an insufficient force tends to be applied to the mobile part 6 for compression of the container body 3.

The tube 5 has a stem 5*a* disposed in the fresh air inlet 15, a locking portion 5*b* provided on the external space S side of the stem 5*a* and preventing entrance of the tube 5 into the intermediate space 21, and a diametrically expanded portion 5*c* provided on the intermediate space 21 side of the stem 5*a* and preventing drawing of the tube 5 from outside the container body 3. The stem 5*a* has a tapered shape towards the intermediate space 21 side. That is, the stem 5*a* has an outer circumferential surface providing a tapered surface. The outer circumferential surface of the stem 5*a* closely contacts with an edge of the fresh air inlet 15 to mount the tube 5 to the container body 3. Such configuration allows reduction in the gap between the tube 5 and the edge of the fresh air inlet 15. As a result, when the container body 3 is compressed, it is possible to inhibit leakage of the air in the intermediate space 21 from the gap between the tube 5 and the edge of the fresh air inlet 15. The tube 5 is mounted to the container body 3 by making the outer circumferential surface of the stem 5*a* close contact with the edge of the fresh air inlet 15, and the diametrically expanded portion 5*c* is thus not essential.

The surface 5*j* surrounding the cavity 5*g* is provided with a stopper 5*h* to lock the mobile part 6 in movement of the mobile part 6 from the intermediate space 21 side towards the external space S side. The stopper 5*h* is configured with an annular projection, and when the mobile part 6 abuts on the stopper 5*h*, to block air communication through the cavity 5*g*.

The tube 5 has an end providing a flat surface 5*d*, and the flat surface 5*d* is provided with an opening 5*e* in communication with the cavity 5*g*. The opening 5*e* has an approximately circular central opening 5*e*1 provided at the center of the flat surface 5*d* and a plurality of slits 5*e*2 radially extending from the central opening 5*e*1. Such configuration does not interfere with air flow even when the mobile part 6 abuts on the bottom of the cavity 5*g*.

As illustrated in FIG. 6F, when the valve member 4 is inserted into the fresh air inlet 15 from the diametrically expanded portion 5*c* side and the locking portion 5*b* is pressed into a position to abut on an outer surface of the outer shell 12, the outer circumferential surface of the stem 5*a* is held in the outer shell 12 in close contact with the edge of the fresh air inlet 15. When the outer shell 12 is compressed while air is in the intermediate space 21, the air in the intermediate space 21 enters into the cavity 5*g* through the opening 5*e* and causes the mobile part 6 to be lifted and abut on the stopper 5*h*. When the mobile part 6 abuts on the stopper 5*h*, the air flow through the cavity 5*g* is blocked.

When the outer shell 12 is further compressed in this state, the pressure in the intermediate space 21 is increased, and as a result, the inner bag 14 is compressed to deliver the contents in the inner bag 14. When the compressive force to the outer shell 12 is released, the outer shell 12 attempts to restore its shape by the elasticity of its own. The pressure in the intermediate space 21 is reduced with the restoration of the outer shell 12, and as illustrated in FIG. 6G, a force FI in direction inside the container is applied to the mobile part 6. This causes the mobile part 6 to move towards the bottom of the cavity 5*g* to the state illustrated in FIG. 6F. Fresh air is thus introduced in the intermediate space 21 through the opening 5*e* and the gap between the mobile part 6 and the surface 5*j*.

The valve member 4 is allowed to be mounted to the container body 3 by inserting the diametrically expanded portion 5*c* into the intermediate space 21 while pressing and expanding the fresh air inlet 15 by the diametrically expanded portion 5*c*. The diametrically expanded portion 5*c* thus has an end preferably in a tapered shape. Being mounted only by pressing the diametrically expanded portion 5*c* into the intermediate space 21 from outside the container body 3, such valve member 4 is excellent in productivity. Since the tube 5 has an end provided with the flat surface 5*d*, the inner bag 14 is not easily damaged even when the valve member 4 is pressed into the intermediate space 21 and the end of the valve member 4 collides with the inner bag 14.

The container may be configured to provide a cover preventing introduction of fresh air into the intermediate space 21 by covering the surroundings of the valve member 4 and the fresh air inlet 15 with the valve member 4 mounted thereto. Such configuration prevents entrance of an odorous gas in a factory into the intermediate space 21 during production. For example, after the inner bag 14 is filled with the contents, the cover may be mounted in a clean atmosphere. Such configuration allows prevention of, for sterilization of the container in high temperature steam, entrance of the steam from the fresh air inlet 15 into the intermediate space 21, causing water remained in the intermediate space 21. While the valve member 4 and the fresh air inlet 15 are covered with the cover, fresh air is not introduced in the intermediate space 21 and the outer shell 12 does not restore its shape after compression. Users are thus supposed to use the container in a state of removing the cover.

As illustrated in FIGS. 7A and 7B, specific configuration examples include a configuration of providing a sealing member 8 to be adhered around the valve member 4 and the fresh air inlet 15. In the example of FIG. 7A, the sealing member 8 is pasted over an annular convex 7*d* provided surrounding the valve member mounting recess 7*a*. In the example of FIG. 7B, the sealing member 8 is pasted over the annular convex 7*d* provided surrounding the valve member 4 and the fresh air inlet 15 in the valve member mounting recess 7*a*. The example of FIG. 7B allows avoiding of protrusion of the sealing member 8 from the surface of the outer shell 12.

As illustrated in FIGS. 1A to 2, the storage portion 7 has a bottom surface 29 with a central recessed region 29*a* and a peripheral region 29*b* provided surrounding the central recessed region 29*a*. In the central recessed region 29*a*, as illustrated in FIG. 2, a bottom sealing portion 27 is provided that protrudes from the bottom surface 29. A method of forming the bottom sealing portion 27 is as follows.

Figure 1B:
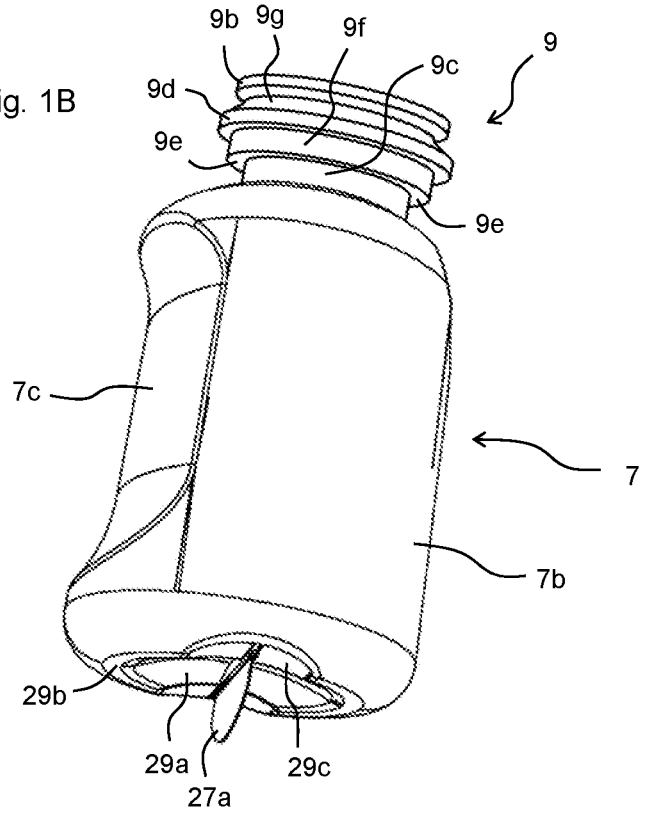

First, as illustrated in FIG. 1B, in blow molding of a tubular laminated parison including the outer layer 11 and the inner layer 13, a sealing portion 27*a* of the laminated parison is formed into a thin film to protrude beyond a plane P (illustrated in FIG. 2) defined by the peripheral region 29*b* in the central recessed region 29*a* (sealing portion forming procedure). The sealing portion 27*a* is formed by sandwiching a laminated parison with a split die for compression in blow molding. The sealing portion 27*a* is formed to have a maximum thickness of preferably ⅓ or less (more preferably, ¼, ⅕, or less) of the thickness of the laminated parison. The sealing portion 27*a* has a thickness of, for example, from 0.1 to 0.4 mm and preferably from 0.2 to 0.3 mm. In an example, a tubular laminated parison with a thickness of 1.5 mm is compressed to 0.25 mm in the sealing portion 27*a*. The sealing portion 27*a* is preferably formed to have an entirely uniform thickness.

Next, as illustrated in FIG. 2, the bottom sealing portion 27 is formed by bending the sealing portion 27*a* to accommodate the sealing portion 27*a* in the central recessed region 29*a*. Since the sealing portion 27*a* is in an extremely thin film shape, it is readily bent to be accommodated in the central recessed region 29*a*. The sealing portion 27*a* may be subjected to melting, instead of bending. Since the sealing portion 27*a* is in an extremely thin film shape, it is readily melted to be accommodated in the central recessed region 29*a*.

The formation of the bottom sealing portion 27 by bending or melting the sealing portion 27*a* allows improvement in impact resistance on the bottom surface 29 of the container body 3. In addition, the bottom sealing portion 27 does not protrude from the plane P. This prevents, when the delaminatable container 1 is stood, inhibition of self-supportability of the delaminatable container 1 due to the bottom seal protrusion 27 sticking out of the plane P.

As illustrated in FIG. 1B, a recess region in the bottom surface 29 is provided across the entire bottom surface 29 in a longitudinal direction of the sealing portion 27*a*. That is, the central recessed region 29*a* is connected to a peripheral recess region 29*c*. Such configuration facilitates bending of the sealing portion 27*a*.

The layer structure of the container body 3 is described below in further detail. The container body 3 is provided with the outer layer 11 and the inner layer 13. The outer layer 11 is formed thicker than the inner layer 13 so as to increase the restorability thereof.

The outer layer 11 is formed of, for example, low-density polyethylene, linear low-density polyethylene, high-density polyethylene, polypropylene, ethylene-propylene copolymer, or a mixture thereof, or the like. For a container having a diameter of 30 mm or less, the outer layer 11 is preferably formed to contain low-density polyethylene. Such configuration facilitates squeeze to discharge the contained liquid. For example, the outer layer 11 may be composed of a single layer of low-density polyethylene. As another example, the outer layer 11 may be composed of a multilayer of low-density polyethylene and a recycled material using burrs generated during molding.

Figure 8:
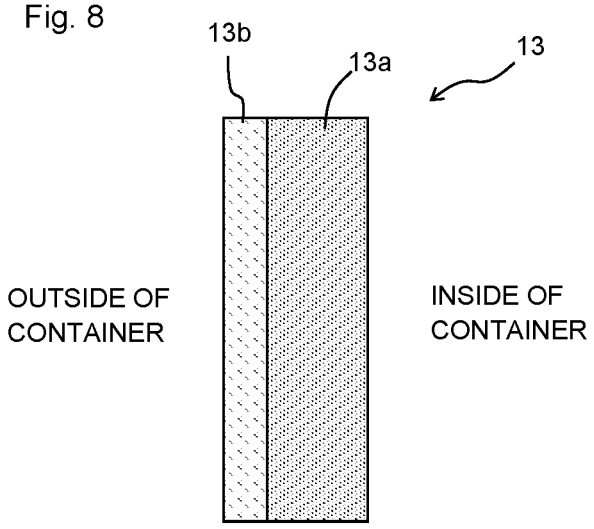
FIG. 8 is a cross-sectional view illustrating configuration of an inner layer 13.

As illustrated in FIG. 8, in the present embodiment, the inner layer 13 includes an innermost layer 13*a* to make contact with the contents and a cover layer 13*b* slidable over the innermost layer 13*a*. Configuration of a cover layer 13*b* containing an EVOH resin or the like with high oxygen barrier properties integrated with the innermost layer 13*a* by adhesion is generally employed. The high rigidity of the EVOH resin accordingly causes difficulty in deformation of the inner layer 13 having the cover layer 13*b* integrated with the innermost layer 13*a* and the inner bag 14 is sometimes not smoothly shrunk. In contrast, in the present embodiment, the innermost layer 13*a* is not adhered to the cover layer 13*b* and the innermost layer 13*a* is slidable over the cover layer 13*b*. The innermost layer 13*a* may be accordingly deformed relatively freely even when the cover layer 13*b* has higher rigidity, and the inner bag 14 is thus shrunk smoothly. In addition, since the innermost layer 13*a* is separated from the cover layer 13*b*, no problem arises as long as the innermost layer 13*a* is not damaged even when the cover layer 13*b* is damaged by mistake during formation of the fresh air inlet 15.

When the innermost layer 13*a* and the cover layer 13*b* are not adhered, the fresh air inlet 15 may be formed to penetrate the outer layer 11 and the cover layer 13*b*. In this case, fresh air is introduced even into the space between the innermost layer 13*a* and the cover layer 13*b*.

The innermost layer 13*a* is a layer to make contact with the contents of the delaminatable container 1. It contains, for example, polyolefin, such as low-density polyethylene, linear low-density polyethylene, high-density polyethylene, polypropylene, an ethylene-propylene copolymer, and a mixture thereof, an EVOH resin, and the like. The resin constituting the innermost layer 13*a* preferably has a tensile modulus of elasticity from 50 to 300 MPa and more preferably from 70 to 200 MPa. This is because the innermost layer 13*a* is particularly flexible when the tensile modulus of elasticity is in such a range. Specifically, the tensile modulus of elasticity is, for example, 50, 100, 150, 200, 250, and 300 Mpa or it may be in a range between any two values exemplified here. When the contents are a chemical solution, the innermost layer 13*a* is preferably of polypropylene or an EVOH resin not to cause easy adsorption of the chemical components by the innermost layer 13*a*. In this case, a more flexible inner layer allows smooth shrinking of the inner layer and prevention of pinholes and the like. The innermost layer 13*a* is thus particularly preferred to be formed using polypropylene. From the perspective of flexibility, a propylene random copolymer is particularly preferred for the innermost layer 13*a*. The propylene random copolymer is a random copolymer of propylene and another monomer and has a content of the monomer other than propylene of less than 50 mol %, preferably from 5 to 35 mol %. Specifically, the content is, for example, 5, 10, 15, 20, 25, and 30 mol % or it may be in a range between any two values exemplified here. As the monomer to be copolymerized with propylene, ethylene is particularly preferred. In the case of a propylene-ethylene random copolymer, the ethylene content is preferably from 5 to 30 mol % and specifically, for example, 5, 10, 15, 20, 25, and 30 mol % or it may be in a range between any two values exemplified here.

The cover layer 13*b* is a layer provided to give oxygen barrier properties and the like and preferably contains an EVOH resin. When the cover layer 13*b* contains an EVOH resin, the delamination properties between the outer layer 11 and the inner layer 13 becomes good.

The EVOH resin is an ethylene-vinyl alcohol copolymer (EVOH) resin and is obtained by hydrolysis of a copolymer of ethylene and vinyl acetate. The EVOH resin has an ethylene content, for example, from 25 to 50 mol %, and from the perspective of oxygen barrier properties, it is preferably 32 mol % or less. Although not particularly defined, the lower limit of the ethylene content is preferably 25 mol % or more because the flexibility of the EVOH resin is prone to decrease when the ethylene content is less. The EVOH resin preferably contains an oxygen absorbent. The content of an oxygen absorbent in the EVOH resin further improves the oxygen barrier properties of the EVOH resin.

The EVOH resin preferably has a melting point higher than the melting point of the resin contained in the outer layer 11. When the fresh air inlet 15 is formed in the outer layer 11 using a thermal perforator, the inlet can be prevented from reaching the inner layer 13 in formation of the fresh air inlet 15 in the outer layer 11 by the EVOH resin having a melting point higher than the melting point of the resin contained in the outer layer 11. From this perspective, a greater difference of (Melting Point of EVOH)−(Melting Point of Resin contained in Outer Layer 11) is desired, and it is preferably 15° C. or more and particularly preferably 30° C. or more. The difference in melting points is, for example, from 5° C. to 50° C. Specifically, it is, for example, 5, 10, 15, 20, 25, 30, 35, 40, 45, and 50° C. or it may be in a range between any two values exemplified here.

As long as the appended claims do not limit the configuration of the inner layer, the configuration of the inner layer 13 is not limited. In this case, an adhesion layer may be provided between the innermost layer 13*a* and the cover layer 13*b*. The adhesion layer is a layer having a function of adhering the cover layer 13*b* to the innermost layer 13*a*, and it is, for example, a product of adding acid modified polyolefin (e.g., maleic anhydride modified polyethylene) with carboxyl groups introduced therein to polyolefin described above or an ethylene-vinyl acetate copolymer (EVA). An example of the adhesion layer is a mixture of acid modified polyethylene with low-density polyethylene or linear low-density polyethylene.

2. Second Embodiment

Figure 9A:
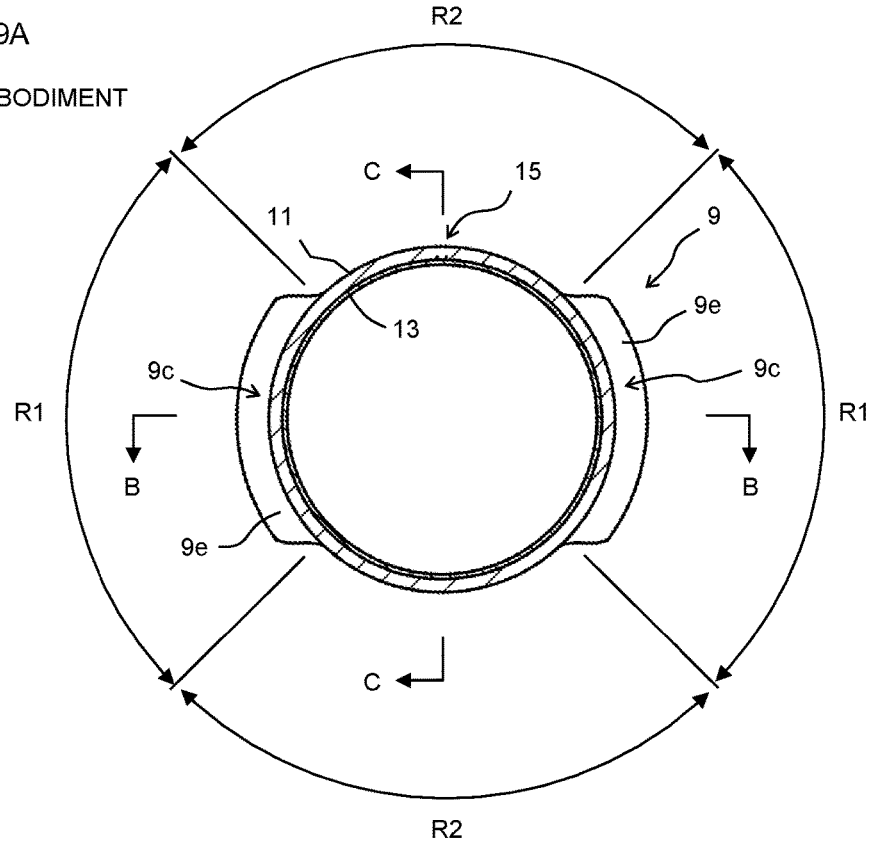
FIGS. 9A to 9C illustrate a mouth 9 of a container body 3 in a second embodiment of the present invention, where
Figure 9B:
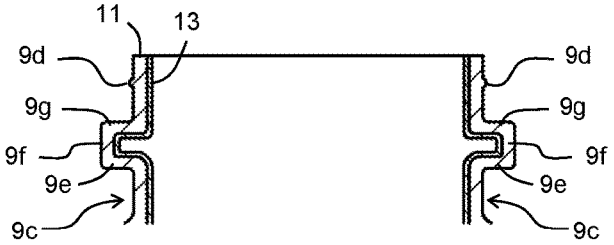
Figure 9C:
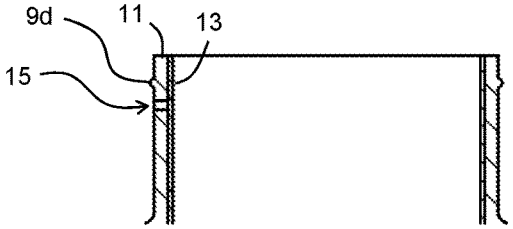
Figure 10A:
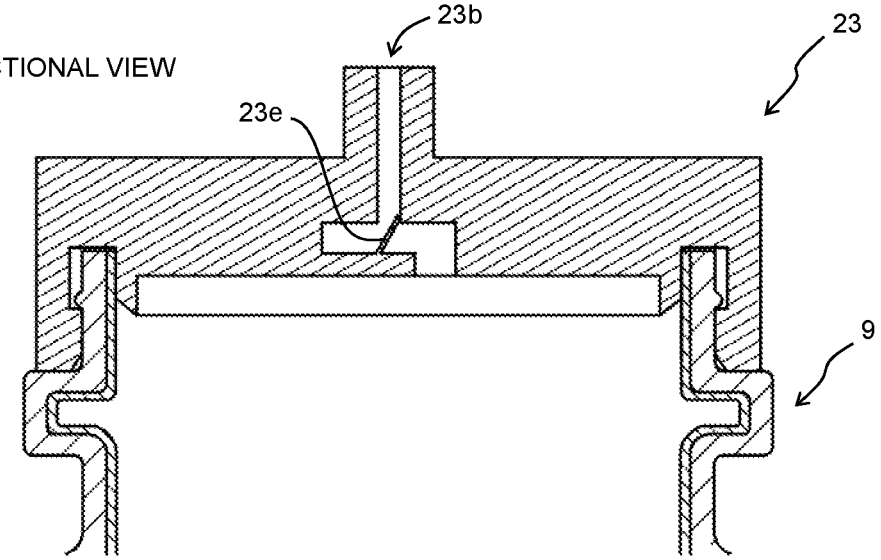
FIGS. 10A and 10B are cross-sectional views illustrating a state where a cap 23 is mounted to a mouth 9 in FIGS. 9B to 9C.
Figure 10B:
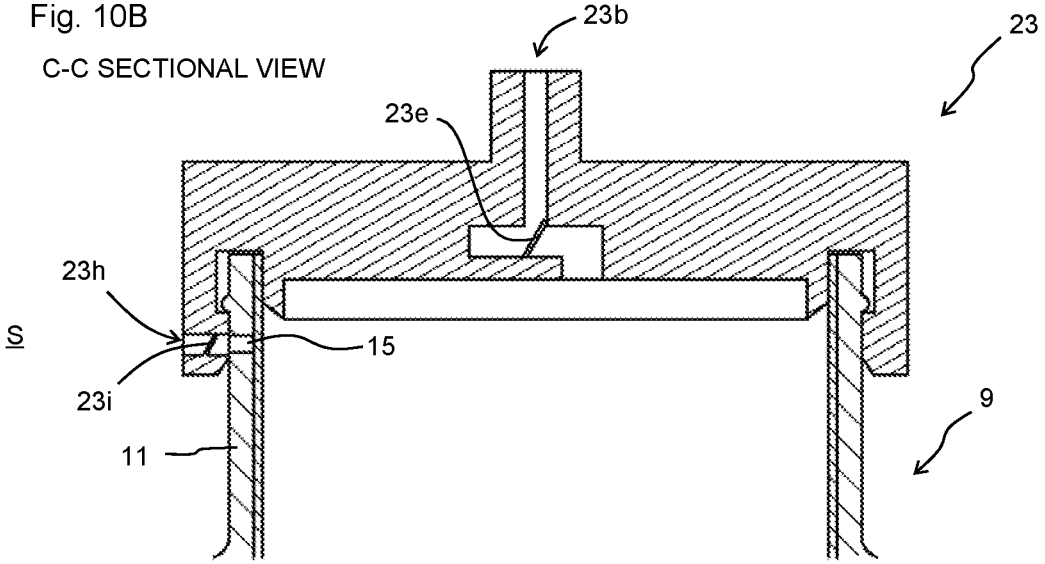

With reference to FIGS. 9A to 9C, a delaminatable container in the second embodiment of the present invention is described. The second embodiment is similar to the second modification of the first embodiment and mainly differs in that a fresh air inlet 15 is provided in a mouth 9, that a constriction section 9*c* has different configuration, and that a check valve 23*i* is provided in a cap 23, instead of the valve member 4. The following description is given mainly to the differences.

In the first embodiment, the mouth 9 is provided with the constriction section 9*c* to have a uniform constriction amount across the entire circumference of the mouth 9, whereas in the present embodiment, the mouth 9 circumferentially has a first region R1 and a second region R2. The first region R1 is configured to include the constriction section 9*c*, and the second region R2 not to include the constriction section 9*c*. That is, in the present embodiment, the constriction section 9*c* is provided only in part of the circumference of the mouth 9. The fresh air inlet 15 is provided in the second region R2.

The cap 23 includes a flow passage 23*h* provided to communicate the fresh air inlet 15 with the external space S and the check valve 23*i* provided in the flow passage 23*h*. The check valve 23*i* has functions of closing the flow passage 23*h*, when the storage portion 7 is compressed, to increase the pressure in the intermediate space 21 and opening the flow passage 23*h*, when the compressive force applied to the storage portion 7 is removed, to pass air therethrough flowing from the external space S to the intermediate space 21. To facilitate communication with the flow passage 23*h* provided in the cap 23, the fresh air inlet 15 is preferably provided in a position closer to an outlet of the mouth 9 than the upper wall 9*e* and more preferably provided in a position closer to the outlet of the mouth 9 than the facing wall 9*g*.

In the present embodiment, the fresh air inlet 15 is provided in the second region R2 where the constriction section 9*c* is not provided, and thus there is no constriction section 9*c* between the fresh air inlet 15 provided in the mouth 9 and the storage portion 7. Accordingly, a flow passage for fresh air is more readily formed between the fresh air inlet 15 and the intermediate space 21 between the outer layer 11 and the inner layer 13 in the storage portion 7 and thus fresh air is more readily introduced into the intermediate space 21.

First Modification of Second Embodiment

Figure 11A:
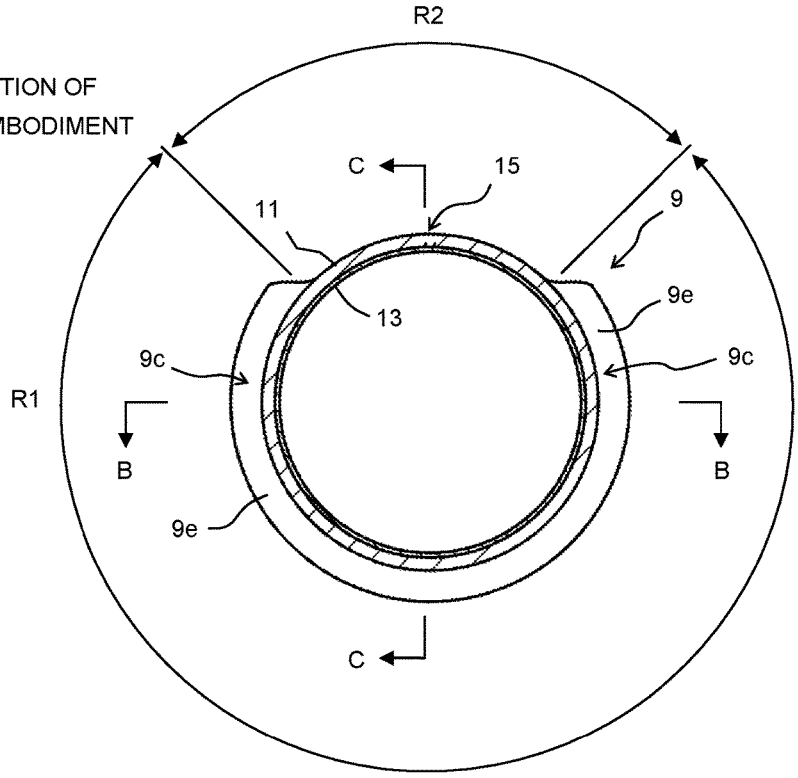
FIGS. 11A to 11C illustrate a mouth 9 of a container body 3 in a first modification of the second embodiment, where
Figure 11B:
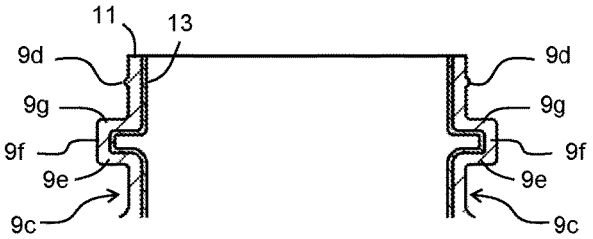
Figure 11C:
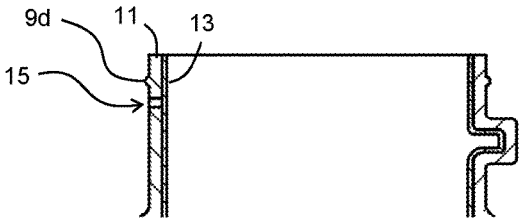

In the second embodiment, the first region R1 and the second region R2 are alternately provided in two areas each on the circumference of the mouth 9 and the first region R1 and the second region R2 are provided respectively at an angle in the range of approximately 90 degrees. Meanwhile, in the first modification, as illustrated in FIGS. 11A to 11C, the first region R1 and the second region R2 are provided in one area each on the circumference of the mouth 9. In such an embodiment as well, it is possible to provide the fresh air inlet 15 in the second region R2 and obtain the same actions and effects as those in the second embodiment.

Second Modification of Second Embodiment

Figure 12A:
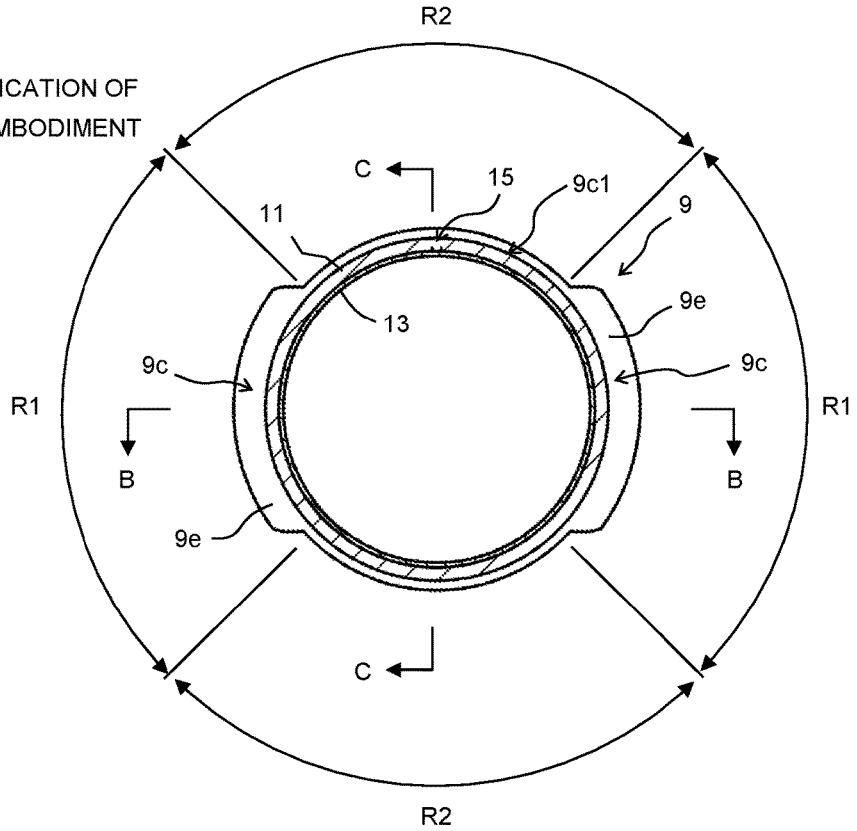
FIGS. 12A to 12C illustrate a mouth 9 of a container body 3 in a second modification of the second embodiment, where
Figure 12B:
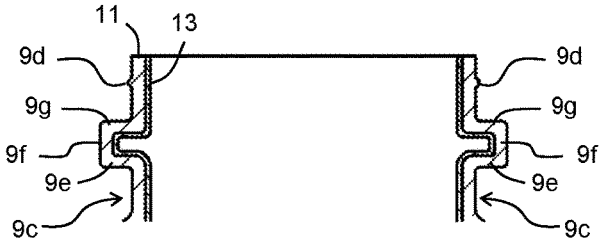
Figure 12C:
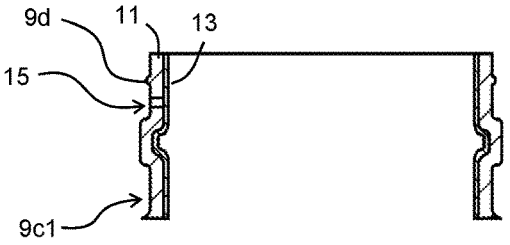

In the second embodiment, the constriction section 9*c* is not provided in the second region R2. Meanwhile, as illustrated in FIGS. 12A to 12C, in the second modification, a minor constriction section 9*c*1 having a constriction amount less than that of the constriction section 9*c* is provided in the second region R2. In the present modification, the minor constriction section 9*c*1 is between the fresh air inlet 15 and the storage portion 7. Since the minor constriction section 9*c*1 has a less constriction amount, it tends not to interfere with formation of a flow passage for fresh air between the fresh air inlet 15 and the intermediate space 21. Accordingly, in the present modification as well, the actions and effects are obtained that are same as those in the second embodiment.

Third Modification of Second Embodiment

Figure 13A:
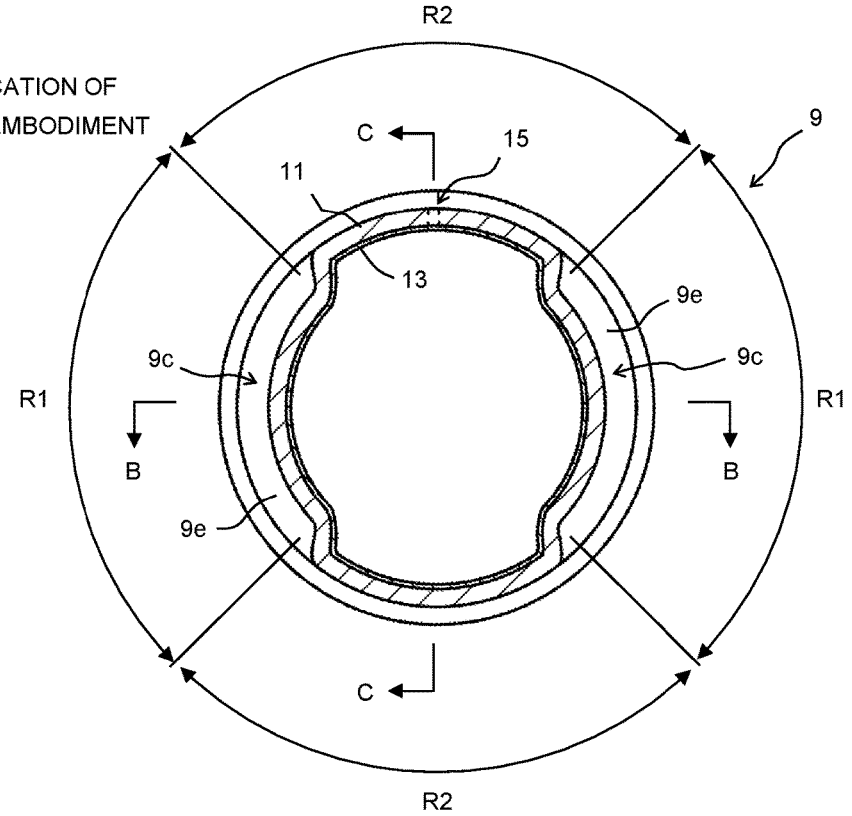
FIGS. 13A to 13C illustrate a mouth 9 of a container body 3 in a third modification of the second embodiment, where
Figure 13B:
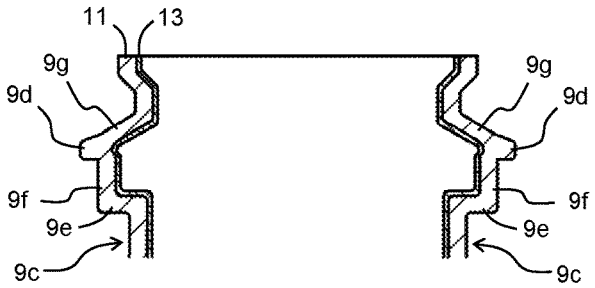
Figure 13C:
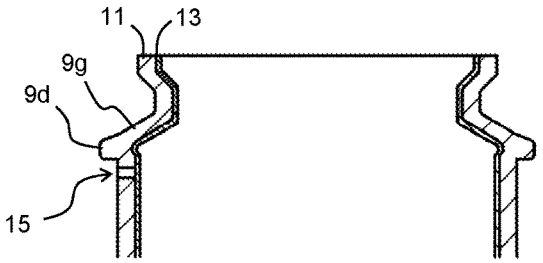

In the second embodiment, as illustrated in FIG. 9A, in the first region R1 of the approximately cylindrical mouth 9, the side wall of the mouth 9 above the constriction section 9*c* protrudes radially outside to form the constriction section 9*c* in the first region R1. The outer circumferential shape of the mouth 9 in the constriction section 9*c* is accordingly approximately circular. In contrast, in the third modification, as illustrated in FIGS. 13A to 13C, the side wall of the approximately cylindrical mouth 9 in the first region R1 is depressed radially inside in the constriction section 9*c* of the mouth 9 to form the constriction section 9*c* in the first region R1. Accordingly, the mouth 9 in the constriction section 9*c* has a noncircular outer circumferential shape and the mouth 9 at the upright wall 9*f* has an approximately circular outer circumferential shape.

In the present modification as well, there is no constriction section 9*c* between the fresh air inlet 15 and the storage portion 7, and the actions and effects are thus obtained that are same as those in the second embodiment. In the present modification, the distance in the second region R2 from the central axis C the mouth 9 to the inner layer 13 is larger than that in the second embodiment. The inner layer 13 is accordingly thinner and the rigidity tends to decrease. The present modification thus has an advantage that the inner layer 13 is more readily delaminated from the outer layer 11 than that in the second embodiment.

Embodiments in the Fifth Aspect of the Invention

Embodiments in the fifth aspect of the present invention are described below. In the following description, the descriptions in common with those in the embodiments in the first to fourth aspects of the present invention are omitted.

3. Third Embodiment

As illustrated in FIGS. 14A to 15C, a delaminatable container 1 in the third embodiment of the present invention includes a container body 3, a valve member 4, a press-fit cap 23 mounted to the container body 3. The container body 3 includes a storage portion 7 to store the contents and a mouth 9 having an opening 9*i* to discharge the contents from the storage portion 7.

As illustrated in FIGS. 15A to 15C, the container body 3 includes an outer layer 11 and an inner layer 13 in the storage portion 7 and the mouth 9. The outer layer 11 constitutes an outer shell 12 and the inner layer 13 constitutes an inner bag 14.

The mouth 9 includes an engagement section 9*d* along the outer circumference of the mouth 9. The mouth 9 in the present embodiment is assumed to have the press-fit cap 23 mounted thereto, and the engagement section 9*d* is an annular projection to be engageable with an engagement section 23*c* of the cap 23.

In addition, the mouth 9 includes a constriction section 9*c* constricting inside the mouth 9 on the storage portion 7 side from the engagement section 9*d*. The constriction section 9*c* has an upper wall 9*e* extending approximately vertically to a central axis C of the mouth 9.

Then, with reference to FIGS. 15A to 16B, a method of mounting the cap 23 to the mouth 9 is described. As illustrated in FIG. 15B, the cap 23 to be mounted includes a cap body 23*a* and a cap cover 23*m*. The cap body 23*a* and the cap cover 23*m* are coupled in a coupling portion 23*j* to allow opening and closing of the cap cover 23*m*. The cap body 23*a* includes a top 23*t*, an outlet 23*b* provided in the top 23*t*, a tubular portion 23*f* cylindrically extending from the outer circumference of the top 23*t*, an engagement section 23*c* provided along the inner circumference of the tubular portion 23*f*, an inner ring 23*d* cylindrically extending from the top 23*t* inside the tubular portion 23*f*, a flow passage 23*g* provided inside the inner ring 23*d* and communicating with the outlet 23*b*, and a check valve 23*e* provided in the flow passage 23*g*. The engagement section 23*c* is an annular projection to be engageable with the engagement section 9*d* of the mouth 9. While the cap 23 is mounted to the mouth 9, the contents in the storage portion 7 are discharged from the outlet 23*b* through the flow passage 23*g*. Meanwhile, the check valve 23*e* blocks an incoming flow of fresh air from the outlet 23*b*, and thus fresh air does not enter the inner bag 14 of the container body 3 to inhibit content degradation. The structure of the cap 23 described here is merely an example, and for example, a cap 23 having a check valve of another configuration may be employed.

For mounting of the cap 23, first, to suppress deformation of the storage portion 7 due to the impact of mounting the cap 23, as illustrated in FIG. 16A, a support 10 is brought to abut on a lower surface of the upper wall 9*e* of the constriction section 9*c*. In that state, as illustrated in FIG. 16B, the engagement section 23*c* of the cap 23 is brought to abut on the engagement section 9*d* of the mouth 9, and from this situation, the cap 23 is pressed further. As illustrated in FIG. 15A, the engagement section 23*c* thus passes over the engagement section 9*d* for engagement of the engagement section 23*c* with the engagement section 9*d*.

In the present embodiment, as illustrated in FIG. 15C, a protrusion 9*h* is provided in a position more distant from the opening 9*i* (position closer to the storage portion 7) than the engagement section 9*d*. The protrusion 9*h* is provided between the engagement section 9*d* and the upper wall 9*e* of the constriction section 9*c*. In other words, while the cap 23 is mounted to the mouth 9 as illustrated in FIG. 15A, the protrusion 9*h* is provided in a position more distant from the opening 9*i* than the engagement section 23*c* of the cap 23. The protrusion 9*h* is formed by enlarging the diameter in the area between the engagement section 9*d* and the upper wall 9*e* of the constriction section 9*c*.

As illustrated in a reference example of FIG. 19, if there is no protrusion 9*h* between the engagement section 9*d* and the upper wall 9*e* of the constriction section 9*c*, a large gap G is formed between an end 23*l* of the tubular portion 23*f* and the mouth 9. The presence of the gap G tends to cause a tilt of the cap 23, and the tilt may cause separation of the inner ring 23*d* from the abutment section 9*a* and entrance of fresh air inside the container body 3. In contrast, in the present embodiment, the protrusion 9*h* is provided between the engagement section 9*d* and the upper wall 9*e* of the constriction section 9*c*. There is thus only a small or no gap between the end 23*l* of the tubular portion 23*f* and the mouth 9 to suppress the tilt of the cap 23 relative to the mouth 9 and inhibit the entrance of fresh air inside the container body 3. In the present embodiment, the protrusion 9*h* functions as "the tilt suppressor" in the appended claims. The protrusion 9*h* may, or does not have to, make contact with the end 23*l*. The protrusion 9*h* and the end 23*l* in contact have an advantage of more effective suppression of the tilt of the cap 23. Meanwhile, the protrusion 9*h* and the end 23*l* not in contact have an advantage of reduction in interference between the end 23*l* and the protrusion 9*h* when the cap 23 is mounted to the mouth 9.

The storage portion 7 includes a valve member mounting recess 7*a* composed of an inclined plane, and the recess 7*a* includes the fresh air inlet 15. The fresh air inlet 15 is a through hole provided only in the outer shell 12 and communicates an intermediate space 21 between the outer shell 12 and the inner bag 14 with an external space S of the container body 3. In the present embodiment, the fresh air inlet 15 has the valve member 4 mounted thereto to regulate entrance and exit of air between the intermediate space 21 and the external space S. The recess 7*a* is provided to avoid interference between the valve member 4 and a shrink film when the storage portion 7 is covered with the shrink film. In addition, not to tightly close the recess 7*a* with the shrink film, an air circulation groove 7*b* is provided that extends in the direction from the recess 7*a* to the mouth 9.

As illustrated in FIGS. 17A to 17C, the valve member 4 includes a stem 4*a* disposed in the fresh air inlet 15, a lid 4*c* provided on the intermediate space 21 side of the stem 4*a* and having a greater cross section than that of the stem 4*a*, and a locking portion 4*b* provided on the external space S side of the stem 4*a* and preventing entrance of the valve member 4 into the intermediate space 21. The lid 4*c* is inserted into the intermediate space 21 while pressing and expanding the fresh air inlet 15, thereby mounting the valve member 4 to the container body 3. Accordingly, the lid 4*c* preferably has an end in a tapered shape. Such a valve member 4 is mountable only by pressing the lid 4*c* into the intermediate space 21 from outside the container body 3 and is thus excellent in productivity.

The lid 4*c* is configured to substantially close the fresh air inlet 15 when the outer shell 12 is compressed and has a shape of a smaller cross section as getting closer to the stem 4*a*. The locking portion 4*b* is configured to allow introduction of air into the intermediate space 21 when the outer shell 12 restores its shape after compression. When the outer shell 12 is compressed, the pressure in the intermediate space 21 becomes higher than the external pressure, leading to leakage of air in the intermediate space 21 from the fresh air inlet 15 to the outside. This pressure difference and the air flow cause movement of the lid 4*c* toward the fresh air inlet 15 to, as illustrated in FIG. 17B, close the fresh air inlet 15 with the lid 4*c*. Since the lid 4*c* has the shape with a smaller cross section as getting closer to the stem 4*a*, the lid 4*c* readily fits in the fresh air inlet 15 to close the fresh air inlet 15.

When the outer shell 12 is compressed even more in this situation, the pressure in the intermediate space 21 increases, and as a result, the inner bag 14 is compressed to discharge the contents of the inner bag 14. When the compressive force to the outer shell 12 is released, the outer shell 12 attempts to restore its shape by the elasticity of its own. At this point, as illustrated in FIG. 17C, the lid 4*c* is separated from the fresh air inlet 15 and the closure of the fresh air inlet 15 is released to introduce fresh air into the intermediate space 21. Not to close the fresh air inlet 15 with the locking portion 4*b*, the locking portion 4*b* includes a flow passage 4*d* to allow introduction of fresh air into the intermediate space 21 through the flow passage 4*d* and the fresh air inlet 15 even when the locking portion 4*b* abuts on the outer shell 12.

The present embodiment is configured that the gap between an edge of the fresh air inlet 15 and the valve member 4 is opened and closed by the movement of the valve member 4 to allow the valve member 4 to open and close the fresh air inlet 15. Meanwhile, the valve member itself may be configured to have a through hole and an on-off valve, which acts to open and close the through hole, thereby opening and closing the fresh air inlet 15.

Then the layer structure of the container body 3 is described in further detail. The container body 3 includes the outer layer 11 and the inner layer 13.

The outer layer 11 is formed of, for example, low-density polyethylene, linear low-density polyethylene, high-density polyethylene, polypropylene, an ethylene-propylene copolymer, or a mixture thereof, or the like. The outer layer 11 may have a multilayer structure. The structure may be, for example, a configuration in which both sides of a repro layer are sandwiched by polypropylene layers. As used herein, the term "repro layer" refers to a layer formed by recycling burrs generated during container molding. The outer layer 11 is formed thicker than the inner layer 13 so as to increase the restorability thereof.

In the present embodiment, the outer layer 11 includes a random copolymer layer containing a random copolymer of propylene and another monomer. The outer layer 11 may be a single layer of the random copolymer or may have a multilayer structure. It may be, for example, a configuration in which both sides of the repro layer are sandwiched by random copolymer layers. Formation of the outer layer 11 using a random copolymer of a specific configuration allows improvement in the shape restorability, transparency, and heat resistance of the outer shell 12.

The random copolymer has a content of a monomer other than propylene of less than 50 mol % and preferably from 5 to 35 mol %. Specifically, this content is, for example, 5, 10, 15, 20, 25, and 30 mol % or it may be in a range between any two values exemplified here. The monomer to be copolymerized with propylene may be one that improves impact resistance of the random copolymer compared with a homopolymer of polypropylene, and ethylene is particularly preferred. In the case of a random copolymer of propylene and ethylene, the ethylene content is preferably from 5 to 30 mol %. Specifically, it is, for example, 5, 10, 15, 20, 25, and 30 mol % or it may be in a range between any two values exemplified here. The random copolymer preferably has a weight average molecular weight from 100 thousands to 500 thousands, and even more preferably from 100 thousands to 300 thousands. Specifically, the weight average molecular weight is, for example, 100 thousands, 150 thousands, 200 thousands, 250 thousands, 300 thousands, 350 thousands, 400 thousands, 450 thousands, and 500 thousands or it may be in a range between any two values exemplified here.

The random copolymer has a tensile modulus of elasticity preferably from 400 to 1600 MPa and more preferably from 1000 to 1600 MPa. This is because the shape restorability is particularly good with a tensile modulus of elasticity in such range. Specifically, the tensile modulus of elasticity is, for example, 400, 500, 600, 700, 800, 900, 1000, 1100, 1200, 1300, 1400, 1500, and 1600 Mpa or it may be in a range between any two values exemplified here.

Since an excessively hard container causes poor usability of the container, the outer layer 11 may be formed by mixing a softening material, such as linear low-density polyethylene, for example, to the random copolymer. Note that, in order not to severely interfere with effective properties of the random copolymer, the material to be mixed with the random copolymer is preferably mixed to be less than 50 weight % based on the entire mixture. For example, the outer layer 11 may be formed of a material having the random copolymer and linear low-density polyethylene mixed at a weight ratio of 85:15.

As illustrated in FIG. 18, the inner layer 13 includes an EVOH layer 13*c* provided on a container outer surface side, an inner surface layer 13*d* provided on a container inner surface side of the EVOH layer 13*c*, and an adhesion layer 13*e* provided between the EVOH layer 13*c* and the inner surface layer 13*d*. By providing the EVOH layer 13*c*, it is possible to improve gas barrier properties and delamination properties from the outer layer 11. The adhesion layer 13*e* may be omitted.

The EVOH layer 13*c* is a layer containing an ethylene-vinyl alcohol copolymer (EVOH) resin and is obtained by hydrolysis of a copolymer of ethylene and vinyl acetate. The EVOH resin has an ethylene content, for example, from 25 to 50 mol %, and from the perspective of oxygen barrier properties, it is preferably 32 mol % or less. Although not particularly defined, the lower limit of the ethylene content is preferably 25 mol % or more because the flexibility of the EVOH layer 13*c* is prone to decrease when the ethylene content is less. The EVOH layer 13*c* preferably contains an oxygen absorbent. The content of an oxygen absorbent in the EVOH layer 13*c* further improves the oxygen barrier properties of the EVOH layer 13*c*.

The inner surface layer 13*d* is a layer to make contact with the contents of the delaminatable container 1. It contains, for example, polyolefin, such as low density polyethylene, linear low density polyethylene, high density polyethylene, polypropylene, an ethylene-propylene copolymer, and a mixture thereof, and preferably low density polyethylene or linear low density polyethylene. The resin contained in the inner surface layer 13*d* preferably has a tensile modulus of elasticity from 50 to 300 MPa and more preferably from 70 to 200 MPa. This is because the inner surface layer 13*d* is particularly flexible when the tensile modulus of elasticity is in such range. Specifically, the tensile modulus of elasticity is, for example, specifically for example, 50, 100, 150, 200, 250, and 300 Mpa or it may be in a range between any two values exemplified here.

The adhesion layer 13*e* is a layer having a function of adhering the EVOH layer 13*c* to the inner surface layer 13*d*, and it is, for example, a product of adding acid modified polyolefin (e.g., maleic anhydride modified polyethylene) with carboxyl groups introduced therein to polyolefin described above or an ethylene-vinyl acetate copolymer (EVA). An example of the adhesion layer 13*e* is a mixture of acid modified polyethylene with low density polyethylene or linear low density polyethylene.

4. Fourth Embodiment

With reference to FIGS. 20A and 20B, the fourth embodiment of the present invention is described. The present embodiment is similar to the third embodiment and mainly differs in that a tilt suppressor is provided in a cap 23.

In the present embodiment, same as the reference example in FIG. 19, the mouth 9 has no protrusion 9*h*. In contrast, the configuration of the cap 23 is different from the reference example in FIG. 19 in that an end 23*l* includes a protrusion 23*k*. A gap G between the cap 23 and the mouth 9 at the end 23*l* is thus narrowed to suppress the tilt of the cap 23 relative to the mouth 9. Accordingly, in the present embodiment, the protrusion 23*k* functions as "the tilt suppressor" in the appended claims.

The present invention is allowed to be carried out in the following embodiments:

- the protrusion 23*k* may be configured to make contact with the mouth 9 although, in the fourth embodiment, the protrusion 23*k* does not make contact with the mouth 9 while the cap 23 is mounted to the mouth 9;
- the mouth 9 may be provided with the protrusion 9*h* and the cap 23 may be provided with the protrusion 23*k* although, in the fourth embodiment, the mouth 9 has no protrusion 9*h;*
- the valve member 4 may be omitted, and in this case, the contents are allowed to be discharged by compression deformation of the outer shell 12 while the fresh air inlet 15 is closed with a finger or the like; and
- the fresh air inlet 15 may be provided in the mouth 9.

REFERENCE SIGNS LIST

1: Delaminatable Container, 3: Container Body, 4: Valve Member, 5: Tube, 6: Mobile Part, 7: Storage Portion, 9: Mouth, 11: Outer Layer, 12: Outer Shell, 13: Inner Layer, 14: Inner Bag, 15: Fresh Air Inlet, 21: Intermediate Space, 23: Cap, 27: Bottom Sealing Portion

The invention claimed is:

1. A delaminatable container, comprising a container body having a storage portion to store contents and a mouth to discharge the contents from the storage portion, the storage portion and the mouth having an outer layer and an inner layer, and having an inner bag composed of the inner layer to be shrunk with a decrease in the contents, wherein the mouth includes an engagement section to be engaged with a cap mounted to the mouth and a constriction section provided on a storage portion side from the engagement section and constricting inside the mouth, the mouth includes an upright wall extending from an outer edge of an upper wall of the constriction section at an angle between 45 and 135 degrees relative to the upper wall, a gap is provided between the inner layer at the upper wall and the inner layer at the upright wall, and wherein the upper wall extends approximately perpendicularly to a central axis of the mouth.

2. The container of claim 1, wherein the upright wall has an angle between 60 and 120 degrees relative to the upper wall.

3. The container of claim 1, further comprising a facing wall extending inside the mouth from an upper edge of the upright wall, wherein a gap is provided between the inner layer at the upper wall and the inner layer at the facing wall.

4. The container of claim 3, wherein the facing wall has an angle between -10 and 80 degrees relative to the upper wall.

5. The container of claim 1, wherein the mouth includes an abutment section to abut on an inner ring of the cap, and the abutment section is provided in an area closer to an outlet of the mouth than the engagement section.

6. The container of claim 1, wherein the mouth circumferentially has a first region provided with the constriction section and a second region provided without the constriction section or provided with a minor constriction section having a constriction amount less than that of the constriction section in the first region, and the second region of the mouth is provided with a fresh air inlet to introduce fresh air into an intermediate space between the outer layer and the inner layer.

7. The container of claim 6, wherein the fresh air inlet is provided in a position closer to an outlet of the mouth than the upper wall.

8. A method of mounting a cap to the container of claim 1, comprising mounting a cap to the mouth in a state that the mouth is supported by a support contacting a lower surface of the upper wall.

9. A delaminatable container, comprising a container body having an outer shell and an inner bag, the inner bag to be shrunk with a decrease in contents, wherein the container body includes a storage portion to store the contents and a mouth to discharge the contents from the storage portion, the outer shell includes a fresh air inlet, in the storage portion, communicating an external space with an intermediate space between the outer shell and the inner bag, the storage portion includes a more rigid portion and a less rigid portion with less rigidity than that of the more rigid portion the fresh air inlet is provided on a less rigid portion side, and wherein the storage portion has a tubular portion in a tubular shape and a panel portion formed by depressing a portion of the tubular portion, the panel portion is the more rigid portion and the tubular portion is the less rigid portion, and wherein, in the tubular portion, the fresh air inlet is provided in a position facing the panel portion.

10. A delaminatable container, comprising: a container body and a press-fit cap mounted to the container body, wherein the container body is configured to include a storage portion to store contents and a mouth having an opening to discharge the contents from the storage portion, the storage portion and the mouth having an outer layer and an inner layer, and having an inner bag composed of the inner layer to be shrunk with a decrease in the contents, the mouth includes a mouth-side engagement section provided along an outer circumference of the mouth, the cap includes a cap-side engagement section provided along an inner circumference of the cap, the mouth-side engagement section and the cap-side engagement section are configured to be engageable with each other while the cap is mounted to the mouth, at least one of the cap and the mouth includes a tilt suppressor to suppress a tilt of the cap relative to the mouth by narrowing a gap between the mouth and the cap in a position more distant from the opening than the cap-side engagement section while the cap is mounted to the mouth, and the storage portion includes a fresh air inlet communicating an external space with an intermediate space between the outer layer and the inner layer.

11. The container of claim 10, wherein the tilt suppressor is a mouth-side protrusion provided on the outer circumference of the mouth.

12. The container of claim 10, further comprising a constriction section constricting inside the mouth provided on a storage portion side from the mouth-side engagement section, wherein the mouth-side protrusion is provided between an upper wall of the constriction section and the mouth-side engagement section.

13. The container of claim 10, wherein the tilt suppressor is a cap-side protrusion provided on the inner circumference of the cap.

14. The container of claim 10, wherein the fresh air inlet is provided with a valve member to regulate entrance and exit of air between the intermediate space and the external space.

* * * * *